US007470138B1

(12) United States Patent
Chen et al.

(10) Patent No.: US 7,470,138 B1
(45) Date of Patent: Dec. 30, 2008

(54) CONNECTOR POSITION ASSURANCE DEVICE AND CONNECTOR ASSEMBLY APPARATUS INCORPORATING THE SAME

(75) Inventors: Ping Chen, West Bloomfield Hills, MI (US); Eng Chuan Lim, Singapore (SG); Vincent Lim Chee Boon, Singapore (SG)

(73) Assignee: J.S.T. Corporation, Farmington Hills, MI (US)

( * ) Notice: Subject to any disclaimer, the term of this patent is extended or adjusted under 35 U.S.C. 154(b) by 0 days.

(21) Appl. No.: 11/779,505

(22) Filed: Jul. 18, 2007

(51) Int. Cl.
*H01R 13/627* (2006.01)

(52) U.S. Cl. ..... 439/352

(58) Field of Classification Search ..... 439/352, 439/353, 354
See application file for complete search history.

(56) References Cited

U.S. PATENT DOCUMENTS

| | | | | |
|---|---|---|---|---|
| 4,946,404 | A * | 8/1990 | Takenouchi et al. | 439/352 |
| 4,984,998 | A * | 1/1991 | Duncan et al. | 439/352 |
| 5,330,369 | A * | 7/1994 | Nozaki et al. | 439/489 |
| 5,370,550 | A * | 12/1994 | Alwine et al. | 439/352 |
| 5,507,666 | A * | 4/1996 | Yamanashi | 439/489 |
| 5,591,041 | A * | 1/1997 | Cecil et al. | 439/352 |
| 5,628,648 | A * | 5/1997 | Higgins et al. | 439/489 |
| 5,681,178 | A * | 10/1997 | Kunkle et al. | 439/352 |
| 5,722,849 | A * | 3/1998 | Alwine | 439/352 |
| 5,775,930 | A * | 7/1998 | Model et al. | 439/352 |
| 5,853,298 | A * | 12/1998 | Pacher | 439/352 |
| 5,910,027 | A * | 6/1999 | Wayt et al. | 439/489 |
| 6,045,388 | A * | 4/2000 | Higgins et al. | 439/352 |
| 6,109,955 | A * | 8/2000 | Hanazaki et al. | 439/489 |
| 6,234,826 | B1 * | 5/2001 | Wilber et al. | 439/352 |
| 6,261,116 | B1 | 7/2001 | Ceru | |
| 6,514,098 | B2 * | 2/2003 | Marpoe et al. | 439/352 |
| 6,716,052 | B2 * | 4/2004 | Kane | 439/352 |
| 6,780,045 | B2 * | 8/2004 | Shuey et al. | 439/489 |
| 6,811,424 | B2 * | 11/2004 | Seminara et al. | 439/352 |
| 6,893,277 | B2 * | 5/2005 | Parrish et al. | 439/188 |
| 7,048,568 | B2 * | 5/2006 | Fisher et al. | 439/352 |
| 7,255,593 | B2 * | 8/2007 | Tyler | 439/489 |
| 7,326,074 | B1 * | 2/2008 | Lim et al. | 439/352 |
| 2002/0086575 | A1 * | 7/2002 | Marpoe et al. | 439/352 |
| 2003/0096527 | A1 * | 5/2003 | Greiner | 439/352 |
| 2004/0166715 | A1 * | 8/2004 | Parrish et al. | 439/352 |
| 2005/0215103 | A1 | 9/2005 | Klein et al. | |

* cited by examiner

*Primary Examiner*—T C Patel
*Assistant Examiner*—Vladimir Imas
(74) *Attorney, Agent, or Firm*—Rader, Fishman & Grauer, PLLC

(57) ABSTRACT

A connector position assurance device includes a base panel member and a latch assembly connected to and extending perpendicularly and forwardly from the base panel member. The latch assembly has a first flexible arm and a second flexible arm disposed in a juxtaposed manner relative to one another on opposing sides of a longitudinal axis. Each one of the first and second flexible arms is operative to move between a normal relaxed state and a flexed state generally in a lateral direction with the first and second flexible arms being resiliently biased to the normal relaxed state. The first flexible arm has a talon portion at a first flexible arm distal end thereof and the second flexible arm has a guiding projection at a second flexible arm distal end thereof. A connector assembly apparatus includes a first connector housing, a second connector housing and the connector position assurance device.

14 Claims, 20 Drawing Sheets

CONNECTOR POSITION ASSURANCE DEVICE AND CONNECTOR ASSEMBLY APPARATUS INCORPORATING THE SAME

FIELD OF THE INVENTION

The present invention relates to a connector position assurance device and a connector assembly apparatus that incorporates the connector position assurance device.

BACKGROUND OF THE INVENTION

Many different types of connector position assurance devices used with electrical connectors are well known in the art. One such connector position assurance device is described in U.S. Pat. No. 6,261,116 to Fink, et al. This convention connector position assurance device (commonly referred to as a "CPA") is located entirely on a first connector of a pair of inter-fitting connectors. The CPA device is actuable only in the event that the two connectors are actually mated. A slide slides between a pre-staged position and a staged position. The latter position is attained only upon release of a CPA actuation lock which automatically occurs upon mating of the connectors. The slide is then slid to the staged position, whereat the slide interferes with a clasp mechanism of the connectors so as to prevent unintentional release of the clasp mechanism.

Another such connector position assurance device is described in U.S. Patent Application Publication No. 2005/0215103 to Klien et al. An electrical connector is employed with a conventional connector position assurance device. The electrical connector includes a housing having a mating end and a wire receiving end. A cover is provided on the wire receiving end of the housing. The cover has a ridge on an interior surface thereof to stabilize the cover on the housing. The cover flexes about the ridge when the cover is mounted on the housing. The connector position assurance device is slidably received in a channel on the cover and is movable between a pre-staged position and a staged position. The connector position assurance device engages a connector latch on the housing to assure that a mating connector is fully mated to the connector when the connector position assurance device is in the staged position. The connector position assurance device includes a simply supported latch beam having a latch element thereon that engages a step in the channel to latch the connector position assurance device to the cover.

There are drawbacks associated with these conventional connector position assurance devices described above. Neither one of these conventional connector position assurance devices is capable of preventing a "half-mating" connection. Further, neither one of these conventional connector position assurance devices is designed to be "pre-set". It is possible with either one of these conventional connector position assurance devices to unexpectedly disengage from the connector. Also, both of these conventional connector position assurance devices apply a "permanent stress" on themselves when pre-set and engaged. Additionally, the invention of Fink et al. is complex and rather wide thereby making it unsuitable for small connectors (commonly referred to as "low position connectors").

It would be beneficial to provide a connector position assurance device that is not permanently stressed when it is engaged with a connector housing. It would also be beneficial to provide a connector position assurance device that can prevent a "half mating" connection. Also, it would be advantageous to provide any connector position assurance device that is designed to be pre-set and prevents unexpected connector disengagement. Further, it would be advantageous if the connector position assurance device is suitable for low position connectors by having a compact design and a simple shape. The present invention provides these benefits and advantages.

SUMMARY OF THE INVENTION

One exemplary embodiment of the present invention is a connector position assurance device that includes a base panel member and a latch assembly. The base panel member extends along and about a longitudinal axis defining a longitudinal direction, a lateral axis defining a lateral direction and a transverse axis defining a transverse direction with the longitudinal axis, the lateral axis and the transverse axis being oriented perpendicularly relative to one another. The latch assembly is connected to and extends generally perpendicularly and forwardly from the base panel in the longitudinal direction. The latch assembly has a first flexible arm and a second flexible arm disposed in a juxtaposed manner relative to one another on generally opposing sides of the longitudinal axis forming a channel therebetween. Each one of the first and second flexible arms is operative to move to and between a normal relaxed state and a flexed state generally in the lateral direction. Each one the first and second flexible arms is resiliently biased to the normal relaxed state. The first flexible arm has a talon portion at a first flexible arm distal end thereof and the second flexible arm has a guiding projection at a second flexible arm distal end thereof.

Another exemplary embodiment of the present invention is a connector assembly apparatus that includes a first connector housing, a second connector housing and the connector position assurance device mentioned immediately above.

The present invention will be better appreciated in view of the detailed description of the exemplary embodiments of the present invention with reference to the accompanying drawings, in which:

BRIEF DESCRIPTION OF THE DRAWINGS

FIG. 14A is a reverse partial perspective view shown partially in cross-section illustrating the connector position assurance device and the second connector housing in a pre-set condition.

DETAILED DESCRIPTION OF THE EXEMPLARY EMBODIMENTS

Figure 1:
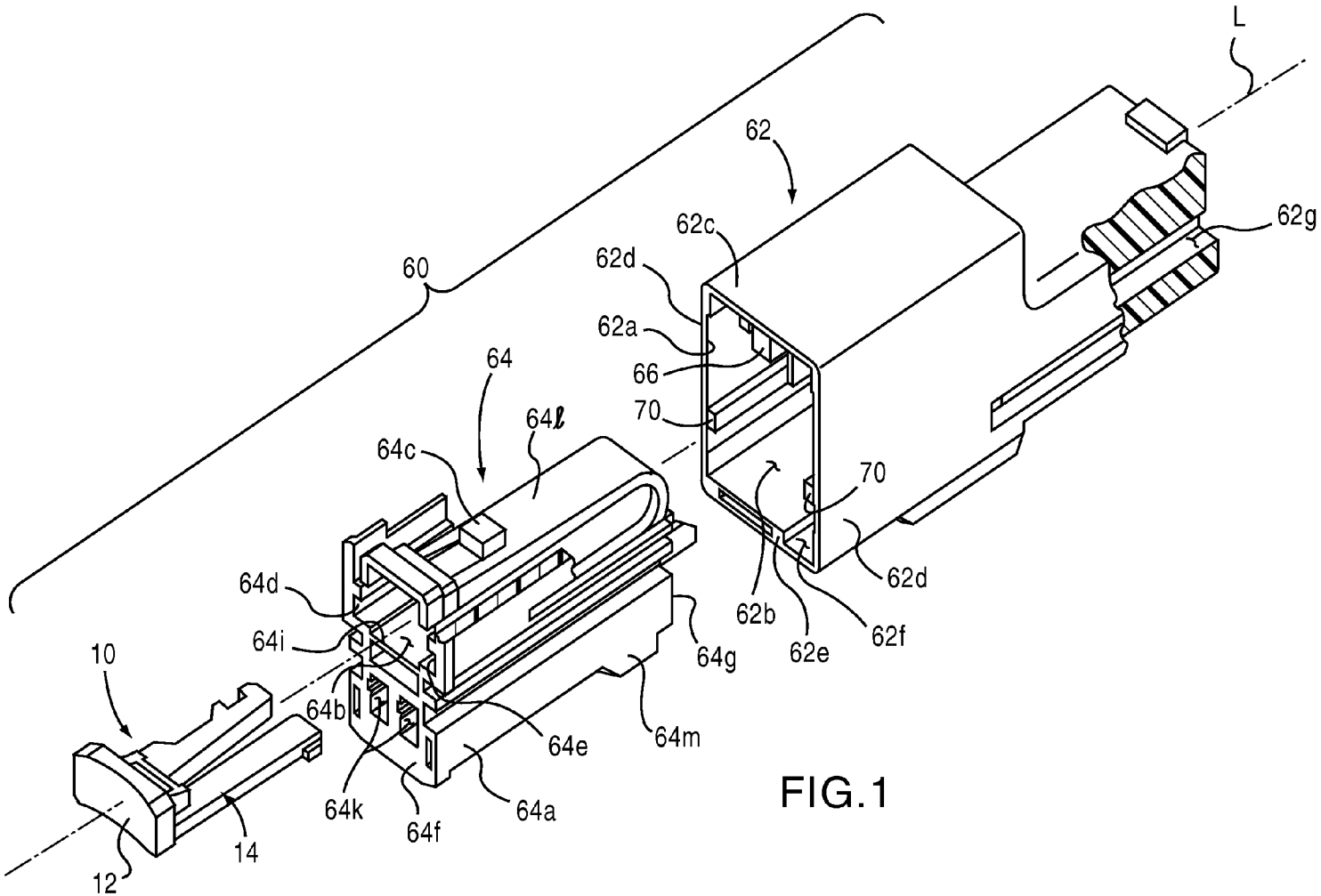
FIG. 1 is an exploded perspective view an exemplary embodiment of a connector position assurance device of the present invention as a component of a connector assembly apparatus that includes a first connector housing and a second connector housing.

Exemplary embodiments of the present invention are hereinafter described. It is emphasized that any terms used herein relating to the orientation of the invention components or the direction of movement of the components including but not limited to "upper", "lower", "upward", "downward", "below". "above", "inwardly", "outwardly", "forward", "forwardly", "rearward", "rearwardly", "front", "rear", "top", "bottom" and the like have been selected for the purpose of simplifying the description of the invention, particularly in view of the drawing figures, for ease of understanding the invention and should not be construed as limiting the scope of the invention. It is believed that using non-descriptive terms unassociated with the orientation of the invention components or direction of movement such as "first", "second" and the like would render the reading and comprehension of the detailed description of the exemplary embodiments of the present invention difficult.

Figure 5:
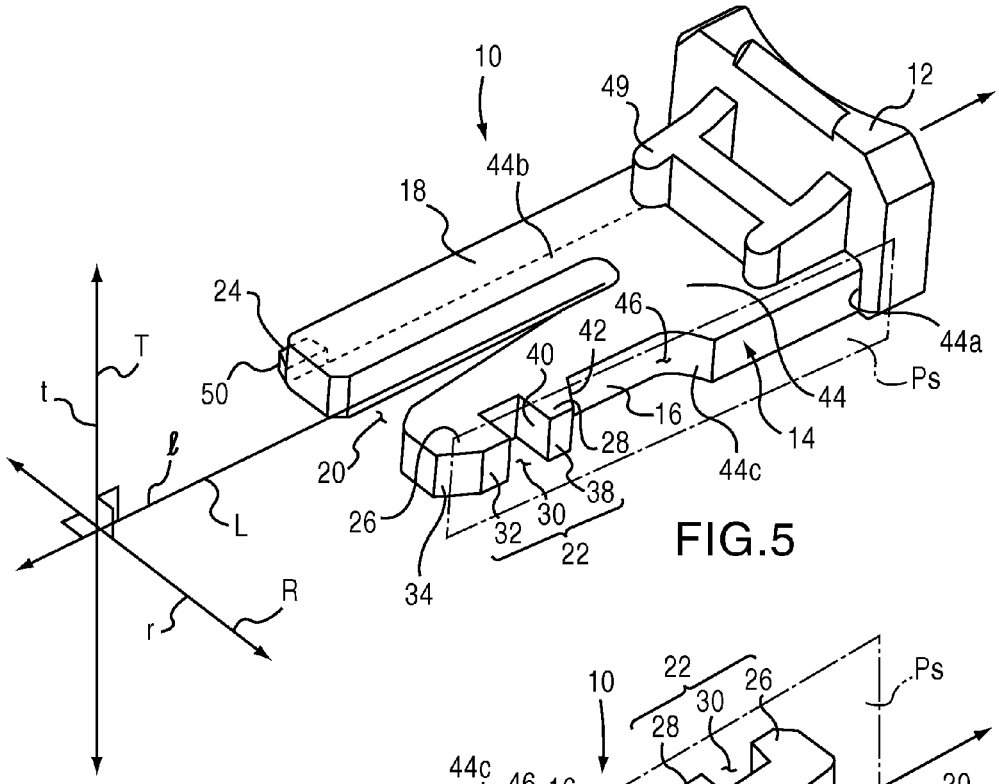
FIG. 5 is a perspective view of the connector position assurance device of the present invention.
Figure 6:
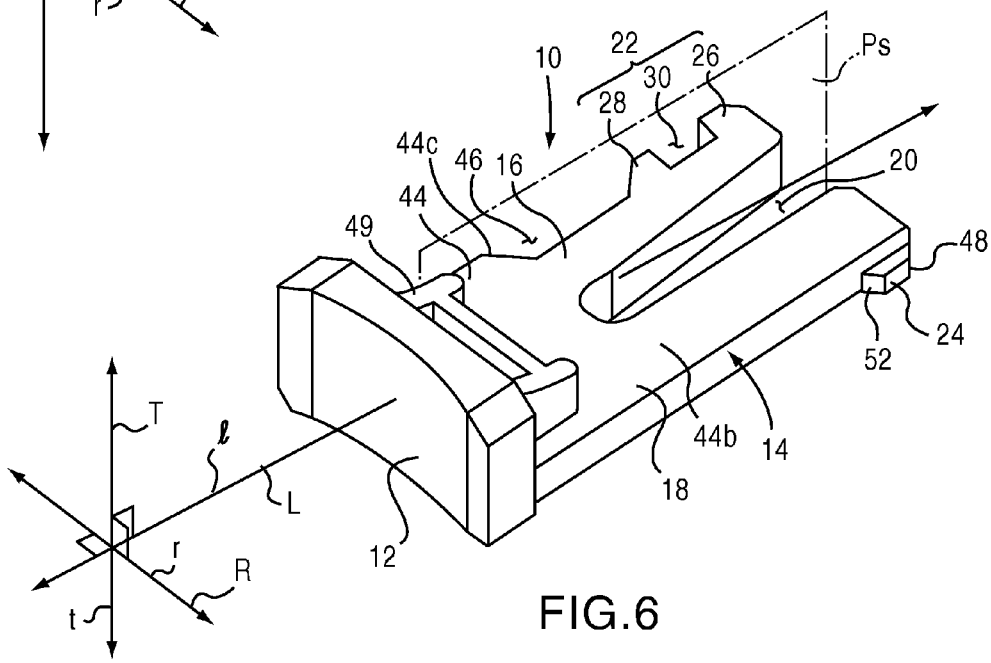
FIG. 6 is a reverse perspective view of the connector position assurance device of the present invention.
Figure 7:
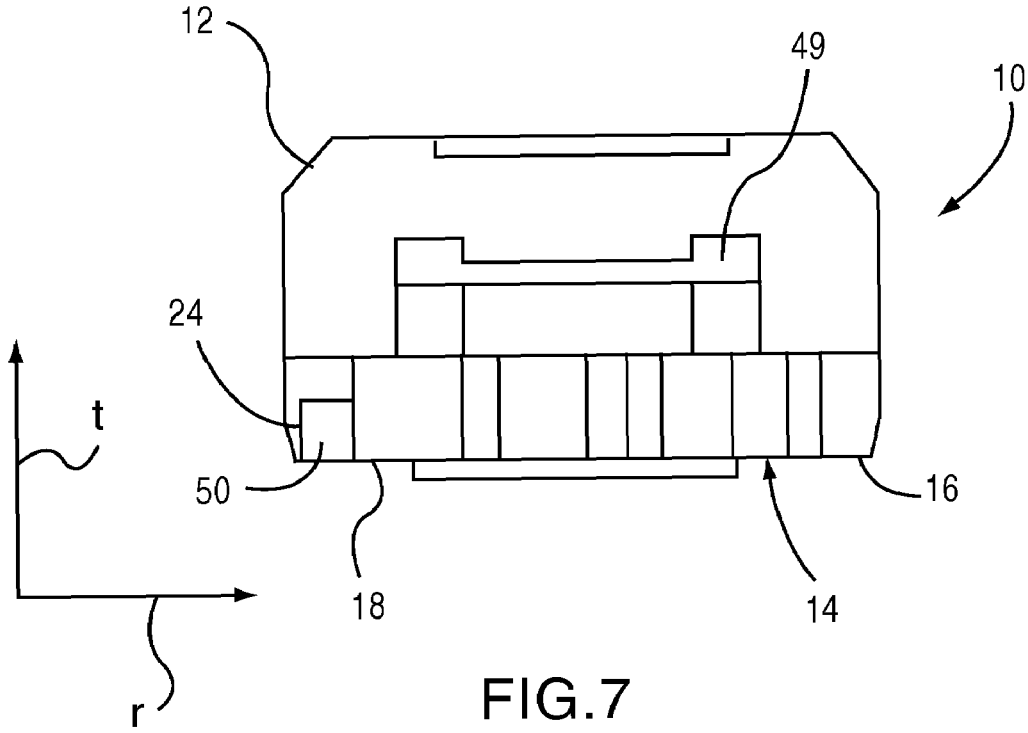
FIG. 7 is a front elevational view of the connector position assurance device of the present invention.
Figure 8:
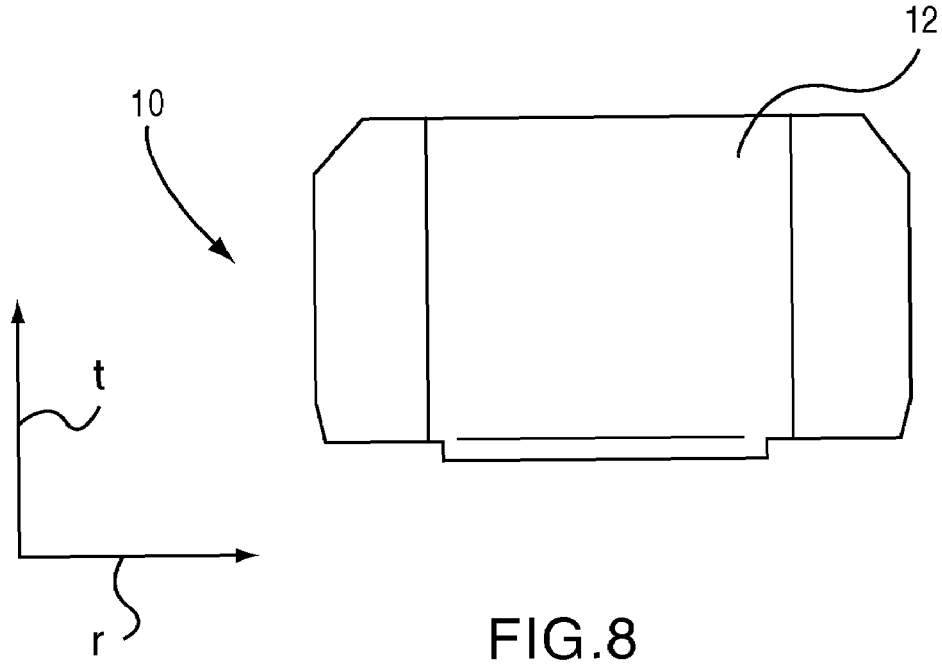
FIG. 8 is a rear elevational view of the connector position assurance device of the present invention.
Figure 9:
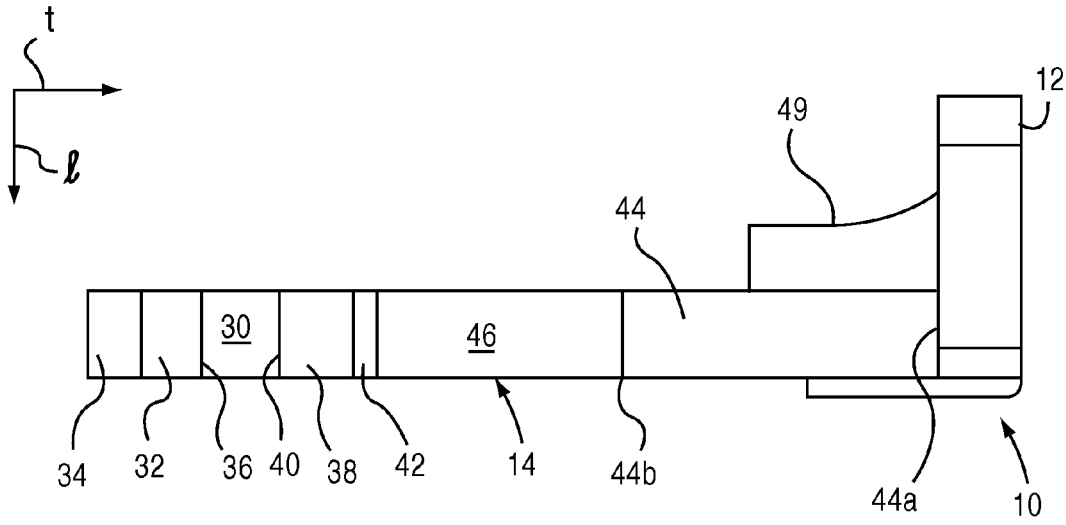
FIG. 9 is a side elevational view of the connector position assurance device of the present invention.
Figure 10:
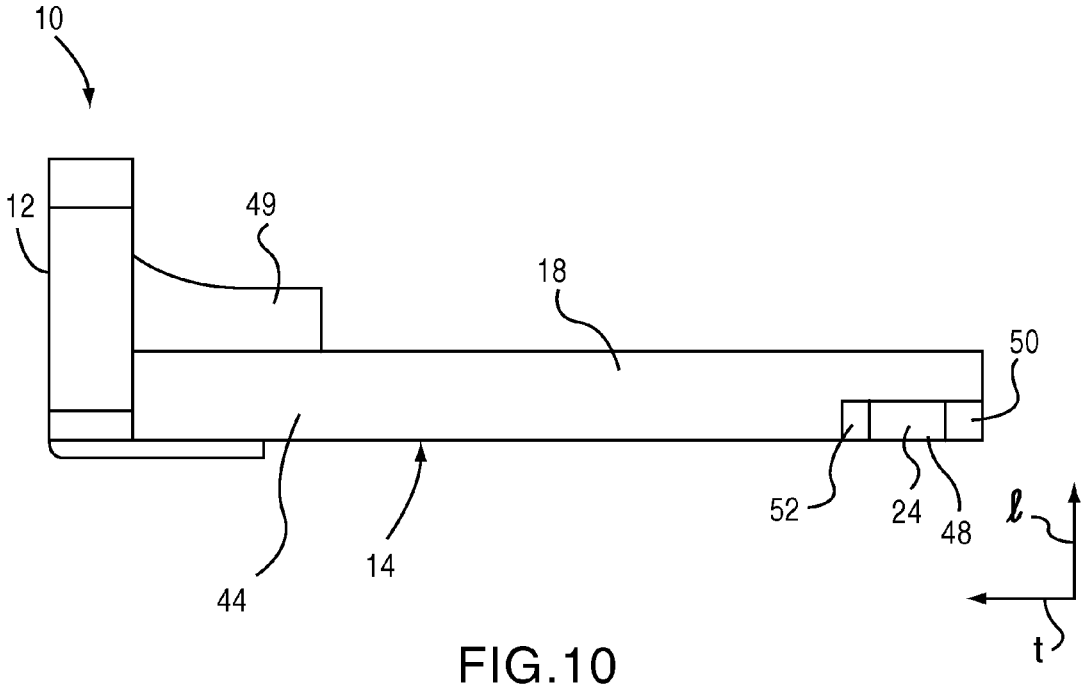
FIG. 10 is an opposite side elevational view of the connector position assurance device of the present invention.

The first exemplary embodiment of a connector position assurance device 10 the present invention is generally introduced in FIGS. 1-12. With reference to FIGS. 5-12, the connector position assurance device 10 includes a base panel member 12 and a latch assembly 14. As best shown in FIGS. 5 and 6, a longitudinal axis L defines a longitudinal direction l, a lateral axis R defines a lateral direction r and a transverse axis defines a transverse direction t. Note that the longitudinal axis L, the lateral axis R and the transverse axis T are oriented perpendicularly relative to one another. The base panel member 12 extends along and about the longitudinal axis L, the lateral axis R and the transverse axis T.

Figure 11:
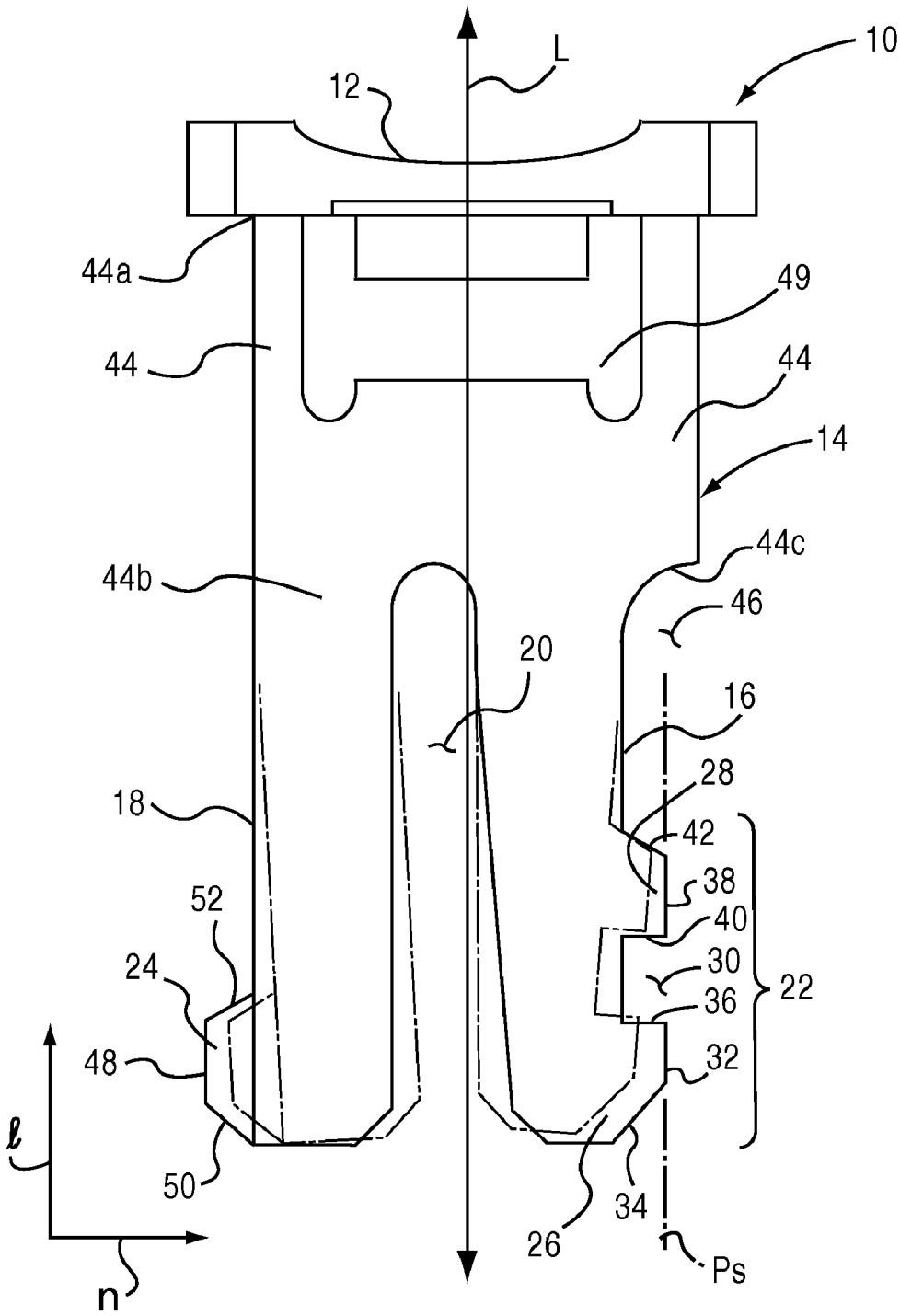
FIG. 11 is a top plan view of the connector position assurance device with its first and second flexible arms in a normal relaxed state and in a flexed state as drawn in phantom.
Figure 12:
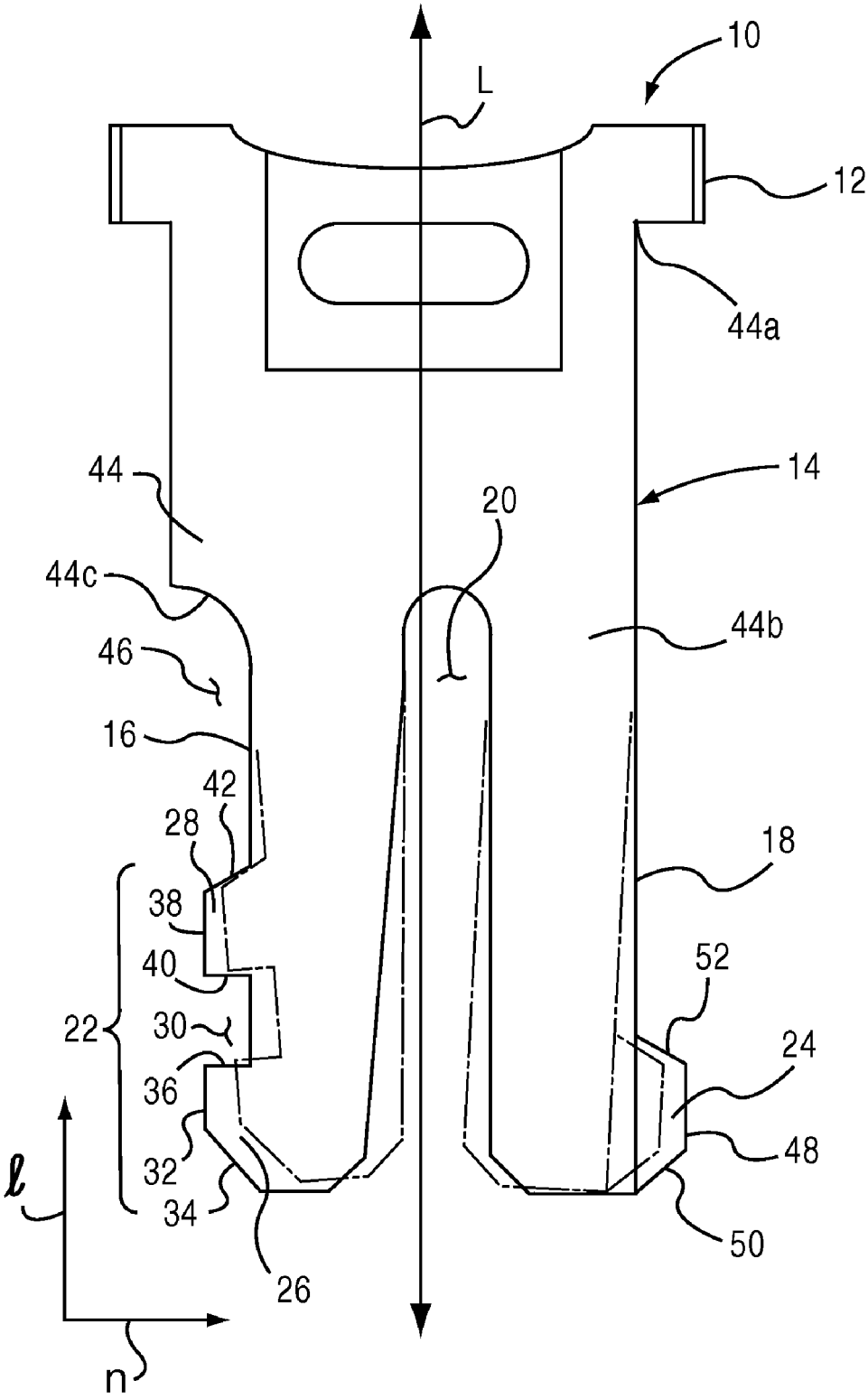
FIG. 12 is a reverse top plan view of the connector position assurance device with its first and second flexible arms in a normal relaxed state and in a flexed state as drawn in phantom.

The latch assembly 14 is connected to and extends generally perpendicularly and forwardly from the base panel member 12 in the longitudinal direction l. Although not by way of limitation, the base panel member 12 and the latch assembly 14 are formed as a unitary construction fabricated from a resin material. The latch assembly has a first flexible arm 16 and a second flexible arm 18. The first flexible arm 16 and the second flexible arm 18 are disposed in a juxtaposed manner relative to one another on generally opposing sides of the longitudinal axis L such that the disposed-apart first and second flexible arms 16 and 18 form a channel 20 therebetween. The channel 20 straddles the longitudinal axis L but not necessarily symmetrically. As best shown in FIGS. 11 and 12, each one of the first and second flexible arms 16 and 18 are operative to move to and between a normal relaxed state (shown in solid lines) and a flexed state (drawn in phantom) generally in the lateral direction r. Each one the first and second flexible arms 16 and 18 is resiliently biased to the normal relaxed state. Further, as best illustrated in FIGS. 5, 6, 11 and 12, the first flexible arm 16 has a talon portion 22 at a first flexible arm distal end thereof, i.e., opposite the base panel member 12. The second flexible arm 18 has a guiding projection 24 at a second flexible arm distal end thereof.

Specifically, with reference to FIGS. 11 and 12, the first and second flexible arms 16 and 18 can move from the normal relaxed state to the flexed state either individually, i.e., individually by themselves, or simultaneously. When one of the first and second flexible arms 16 or 18 moves from the normal relaxed state to the flexed state, the moving one of the first and second flexible arms 16 or 18 moves toward a non-moving one of the first and second flexible arms 16 or 18. When the first and second flexible arms 16 and 18 move simultaneously from the normal relaxed state to the flexed state, the first and second flexible arms 16 and 18 move toward each other.

In FIGS. 5, 6, 11 and 12, the talon portion 22 projects in the lateral direction r with the talon portion 22 facing away from the longitudinal axis L. The talon portion 22 includes a first finger projection 26 and a second finger projection 28 that is disposed apart from the first finger projection 26 to form a notch 30 therebetween. As best shown in FIGS. 5, 9, 11 and 12, the first finger projection 26 includes a first finger projection flat sidewall surface 32, a first finger projection forwardly tapering sidewall surface 34 and a first finger projection rearward flat sidewall surface 36. The first finger projection flat sidewall surface 32 extends substantially parallel with the longitudinal and transverse axes L and T respectively and defines a sidewall plane Ps as shown in FIGS. 5 and 11. The first finger projection forwardly tapering sidewall surface 34 is connected to the first finger projection flat sidewall surface 32 and tapers forwardly and inwardly towards the longitudinal axis L as viewed in plan view of the FIGS. 11 and 12. The first finger projection rearward flat sidewall surface 36 is connected generally perpendicularly to the first finger projection flat sidewall surface 32.

The second finger projection 28 includes a second finger projection flat sidewall surface 38, a second finger projection forward flat sidewall surface 40 and a second finger projection rearwardly tapering sidewall surface 42. The second finger projection flat sidewall surface 38 is coexistent with the first finger projection flat sidewall surface 32 in the sidewall plane Ps. The second finger projection forward flat sidewall surface 40 is connected generally perpendicularly to the second finger projection flat sidewall surface 38 and faces the first finger projection rearward flat sidewall surface 36 to define a generally square configuration of the notch 30 as viewed in plan view. The second finger projection rearwardly tapering sidewall surface 42 is connected to the second finger projection flat sidewall surface 38 and tapers rearwardly and inwardly towards the longitudinal axis L.

Furthermore, as shown in FIGS. 5, 6, 9, 11 and 12, the latch assembly 14 includes an arm mounting panel 44. The arm mounting panel 44 is connected to the base panel member 12 at one arm mounting panel end 44*a* and respective ones of the first and second flexible arms 16 and 18 are connected to the arm mounting panel 44 at an opposing arm mounting panel end 44*b*. Note, as shown in FIGS. 5, 6, 11 and 12, the first flexible arm 16 is attached to the arm mounting panel 44 laterally inwardly relative to a forward corner portion 44*c* of the arm mounting panel 44 to define an indentation 46 between the forward corner portion 44*c* and the second finger projection 28. The indentation 46 extends longitudinally along the first flexible arm 16 such that the indentation 46 faces away from the longitudinal axis L. Further, the latch assembly 14 includes a pleatau member 49 that is connected to the base panel member 12 and the arm mounting panel 44.

As best shown in FIGS. 5, 6, 7, 10, 11 and 12, the guiding projection 24 projects in the lateral direction I and faces away from the longitudinal axis L. The guiding projection 24 includes a guiding projection flat sidewall surface 48, a guiding projection forwardly tapering sidewall surface 50 and a guiding projection rearwardly tapering sidewall surface 52. The guiding projection flat sidewall surface 48 extends substantially parallel with the longitudinal and transverse axes L and T respectively. The guiding projection forwardly tapering sidewall surface 50 is connected to the guiding projection finger projection flat sidewall surface 48 and tapers forwardly and inwardly towards the longitudinal axis L as viewed in plan view (FIGS. 11 and 12). The guiding projection rearwardly tapering sidewall surface 52 is connected to the guiding projection flat sidewall surface 48 and tapers rearwardly and inwardly towards the longitudinal axis L as viewed in plan view.

Figure 2:
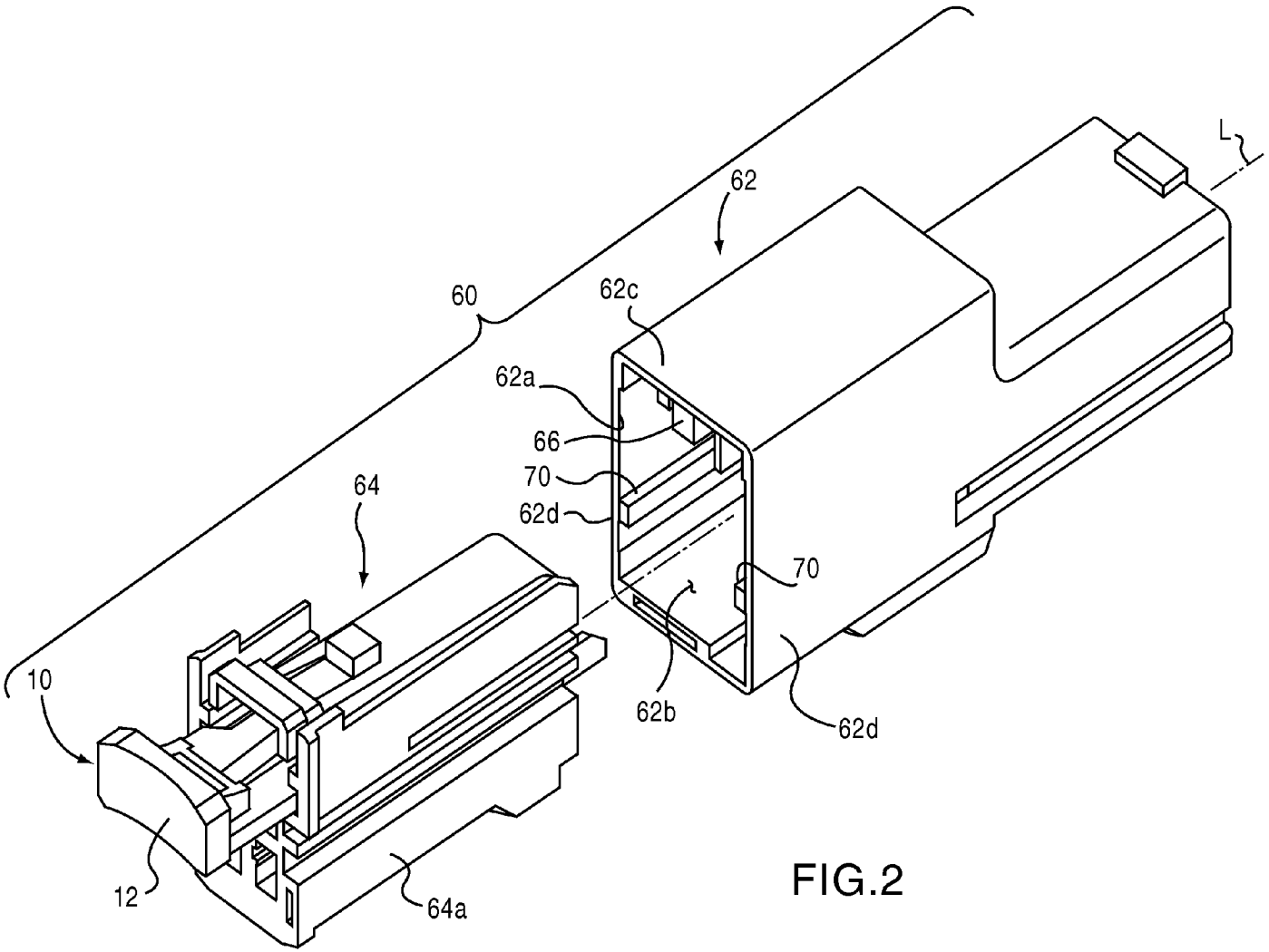
FIG. 2 is an exploded perspective view similar to FIG. 1 with the connector position assurance device received by the second connector housing.
Figure 3:
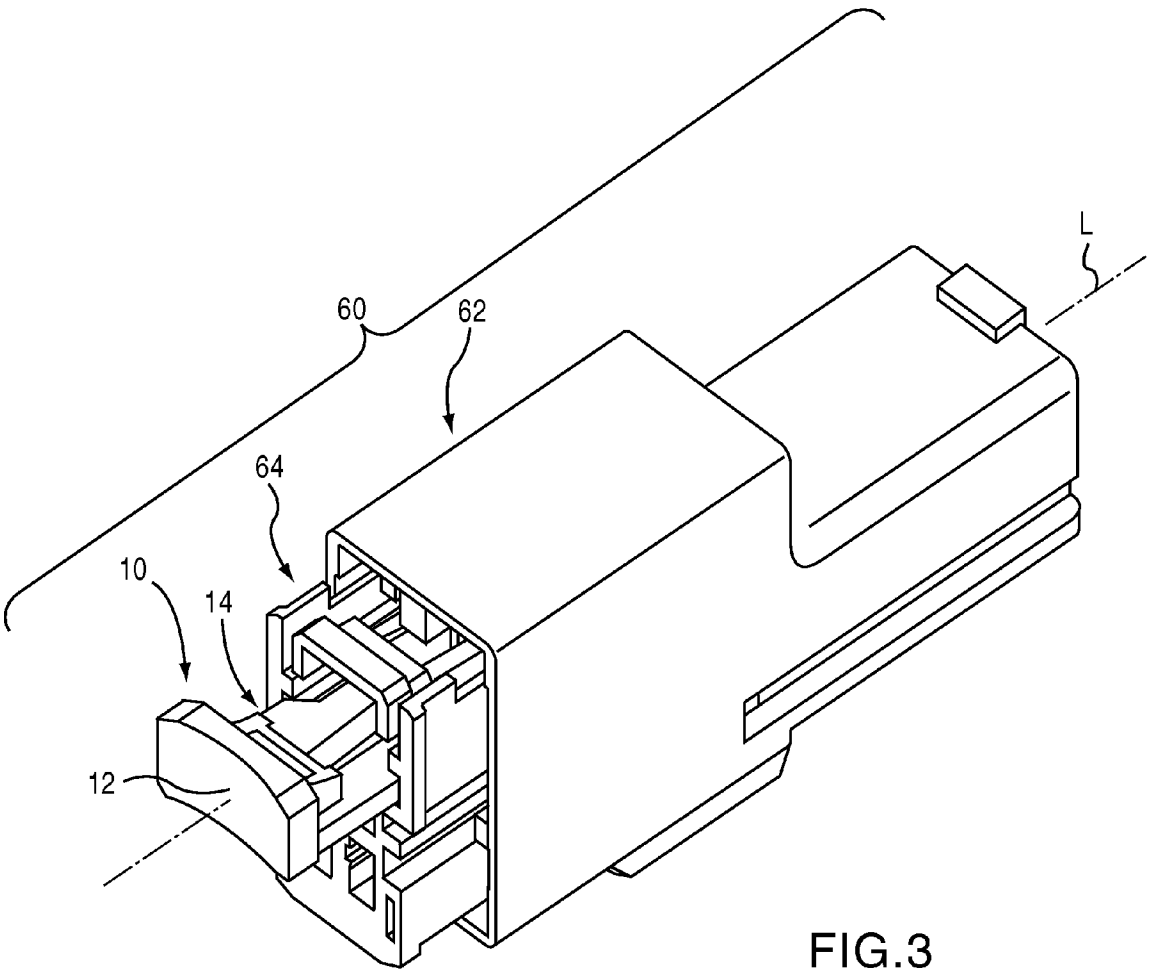
FIG. 3 is an exploded perspective view similar to FIG. 2 with the connector position assurance device releasably connected to the second connector housing being received by the first connector housing.
Figure 4:
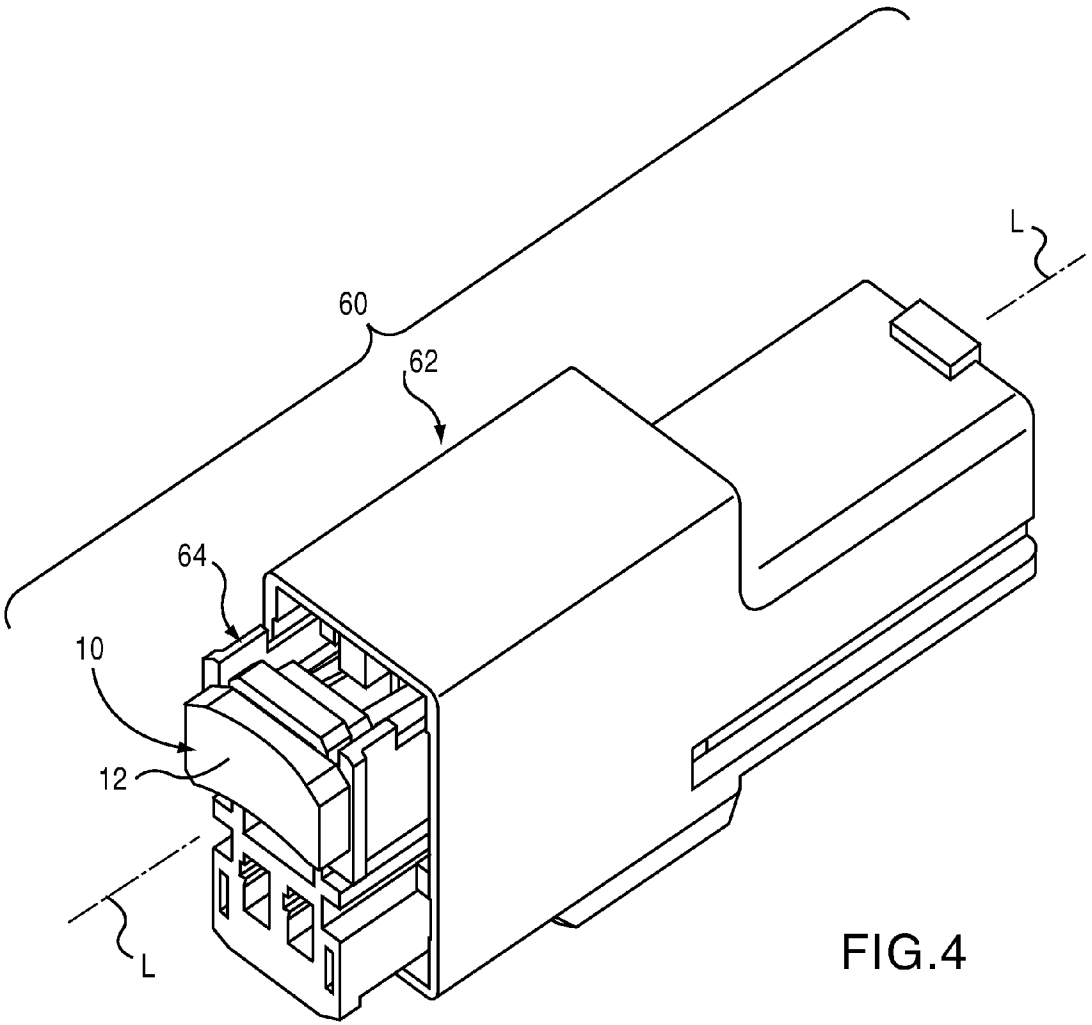
FIG. 4 is an enlarged perspective view similar to FIG. 3 with the connector position assurance device of the present invention fully engaged with the second connector housing.

A second exemplary embodiment of a connector assembly apparatus 60 is generally introduced in FIGS. 1-3. The connector assembly apparatus 60 includes a first connector housing 62, a second connector housing 64 and the connector position assurance device 10.

Figure 13A:
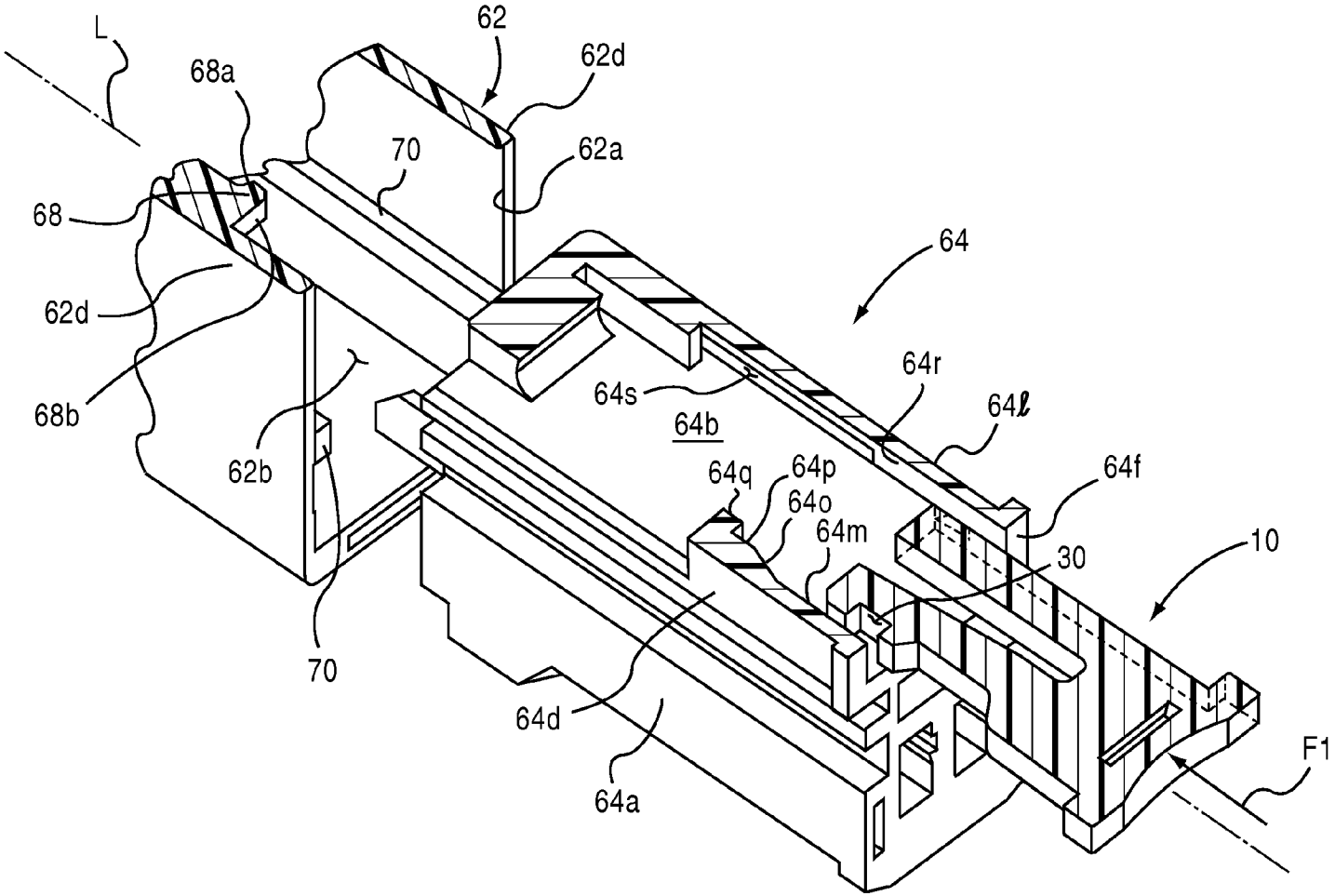
FIG. 13A is a partial perspective view shown partially in cross-section illustrating the connector position assurance device being inserted into the second connector housing.

In FIGS. 1, 2 and 13A, the first connector housing 62 extends along and about the longitudinal axis L and has a first connector opened end 62*a*, a first connector inner cavity 62*b*, a first connector stop projection 66 and a first connector locking projection 68 (FIG. 13A). The first connector stop projection 66 extends from a first connector upper wall 62*c* into the first connector inner cavity 62*b*. The first connector stop projection 66 disposed adjacent the first connector opened end 62*a*. In FIG. 13A, the first connector locking projection 68 extends from one of a pair of opposing first connector sidewalls 62*d*, The pair of opposing first connector sidewalls are oriented perpendicularly to the first connector upper wall 62*c*. The first connector locking projection 68 extends into the first connector inner cavity 62*b* from the one of the pair of opposing first connector sidewalls 62*d*. The first connector housing 62 also includes a pair of opposing first connector rails 70 disposed apart from one another. A respective one of the pair of opposing first connector rails 70 is connected to a respective one of the pair of opposing first connector sidewalls 62*d*. Also, a first connector bottom wall 62*e* includes a first connector foot-receiving channel 62*f* disposed below one of the pair of first connector rails 70. Further, as shown in FIG. 1, a rearward portion of the first connector housing 62 includes at least one terminal-receiving passageway 62*g*.

In FIGS. 1, 2 and 13A, the second connector housing 64 extends along and about the longitudinal axis L and is sized and adapted to be received by the first connector inner cavity 62*b* through the first connector opened end 62*a*. The second connector housing 64 includes a second connector housing body 64*a*, a second connector latch 64*l*, a stop projection 64*c*, a ramped second connector sidewall 64*d* and a slotted second connector sidewall 64*e* facially opposing the ramped second connector sidewall 64*d*. The second connector housing body 64*a* extends longitudinally along the longitudinal axis L between a second connector front end 64*f* and a second connector rear end 64*g*. The second connector latch 64*l* is pivotally connected adjacent the second connector rear end 64*g* and extends between the second connector front and rear ends 64*f* and 64*g* respectfully. As best shown in FIG. 1, the second connector latch 64*l*, the second connector housing body 64*a*, the ramped second connector sidewall 64*d* and the slotted second connector sidewall 64*e* define a second connector inner cavity 64*h* with a second connector opened end 64*i* at the second connector front end 64*f*. The second connector housing body 64*a* also includes a pair of rail-receiving channels 64*j* that extend longitudinally, at least one terminal-receiving bore 64*k* and a second connector foot 64*m* that is sized and positioned to be received by the first connector foot-receiving channel 62*f*.

Figure 15:
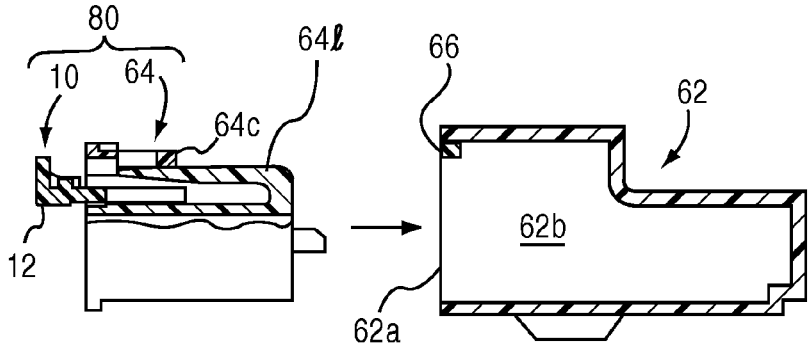
FIG. 15 is a side elevational view in cross-section of the connector position assurance device and the second connector housing in a pre-set condition prior to being inserted into the first connector housing.
Figure 16:
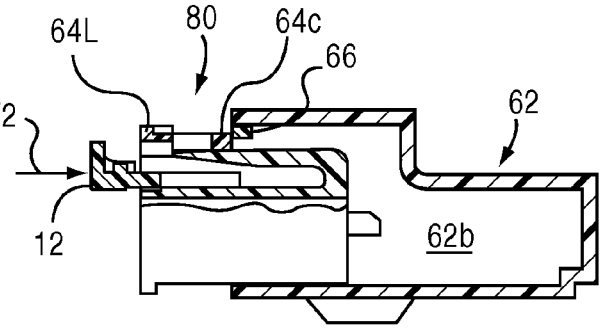
FIG. 16 is a side elevational view in cross-section of the connector position assurance device and the second connector housing in a pre-set condition partially inserted into the first connector housing.
Figure 17:
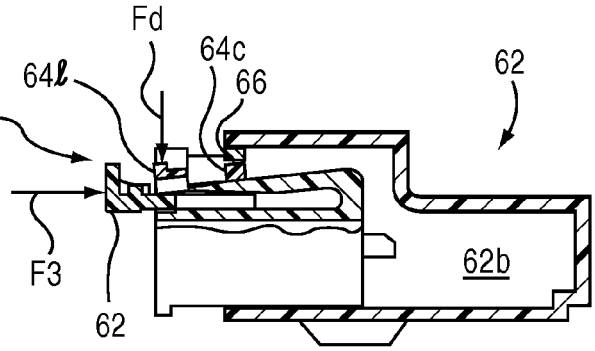
FIG. 17 is a side elevational view in cross-section of the connector position assurance device and the second connector housing in a pre-set condition being inserted into the first connector housing while applying a downwardly force on a second connector latch.
Figure 18A:
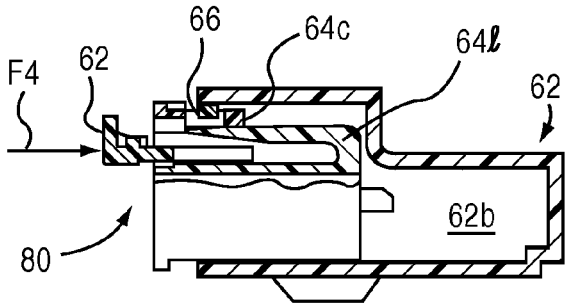
FIG. 18A is a side elevational view in cross-section of the connector position assurance device and the second connector housing in a pre-set condition and being releasably retained in the first connector housing.

With reference to FIGS. 15, 16, 17 and 18A, the second connector latch 64*l* is operative to move to and between a second connector latch normal relaxed state (shown in FIGS. 15, 16 and 18A) and a second connector flexed state (shown in FIG. 17). The second connector latch 64*l* is resiliently biased to the second connector latch normal relaxed state (FIGS. 15, 16 and 18A). The stop projection 64*c* is connected to the second connector latch 64*l* between the second connector front and rear ends 64*f* and 64*g* respectively and extends upwardly therefrom and away from the second connector inner cavity 64*b*.

Figure 13B:
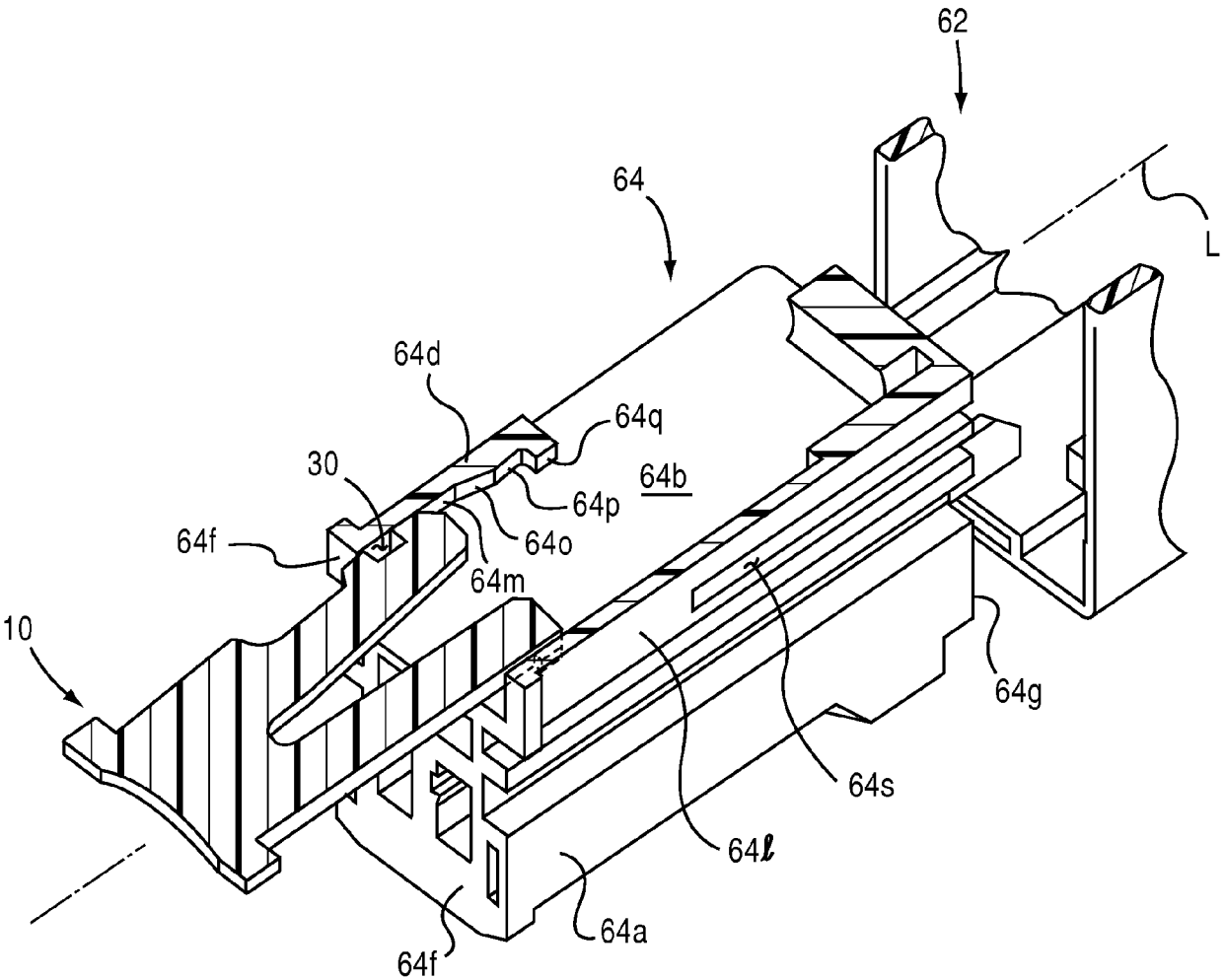
FIG. 13B is a partial reverse perspective view shown partially in cross-section illustrating the connector position assurance device being inserted into the second connector housing.

As best shown in FIGS. 13A and 13B, the ramped second connector sidewall 64*d* includes a first flat cam surface 64*n*, a ramped cam surface 64*o*, a second flat cam surface 64*p* and a second connector locking projection 64*q* progressively extending into the second connector inner cavity 64*b* from the second connector front end 64*f* with the ramped cam surface 64*o* interconnecting the first and second flat cam surfaces 64*n* and 64*p* respectively and the second flat cam surface 64*p* disposed between the ramped cam surface 640 and the second connector locking projection 64*q*. The slotted second connector sidewall 64*e* includes a flat contact surface 64*r* (FIG. 13A) facially opposing at least the first flat cam surface 64*n* and extends parallel to the first cam surface 64*n* and a slot 64*s* that extends longitudinally and facially opposing at least the second connector locking projection 64*q*. As illustrated, the first flat cam surfaces 64*n*, the second flat cam surface 64*p* and the slotted second connector sidewall 6, including the flat contact surface 64*r* and the slot 64*s* extend parallel to the longitudinal axis L.

The operation of the connector assembly apparatus 60 is best illustrated in view of FIGS. 13A-20B in series. A skilled artisan would comprehend that the operation of the connector assembly apparatus 60 is also illustrated serially by the perspective views in FIGS. 1-4.

Figure 14A:
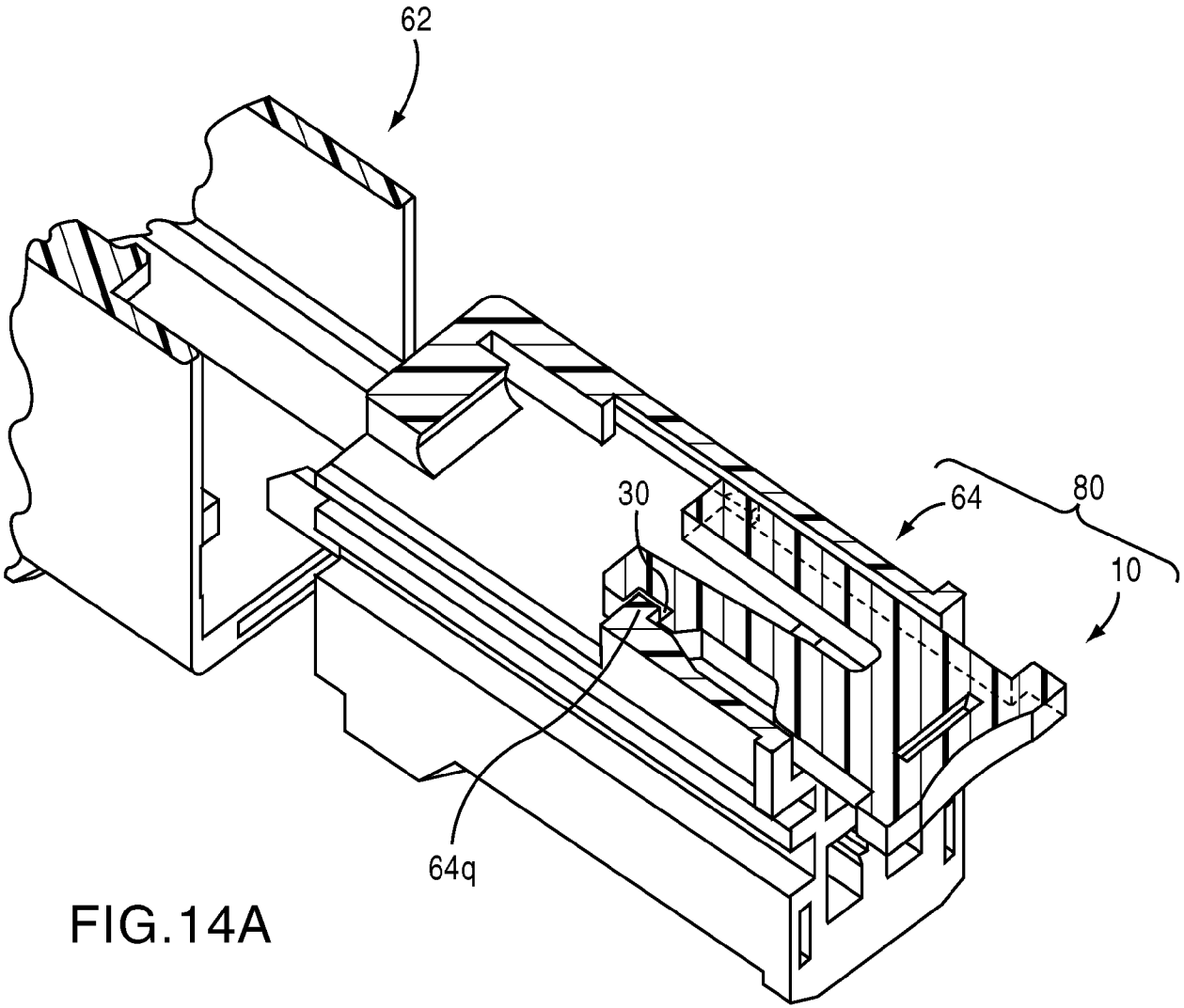
FIG. 14A is a partial perspective view shown partially in cross-section illustrating the connector position assurance device and the second connector housing in a pre-set condition.
Figure 14B:
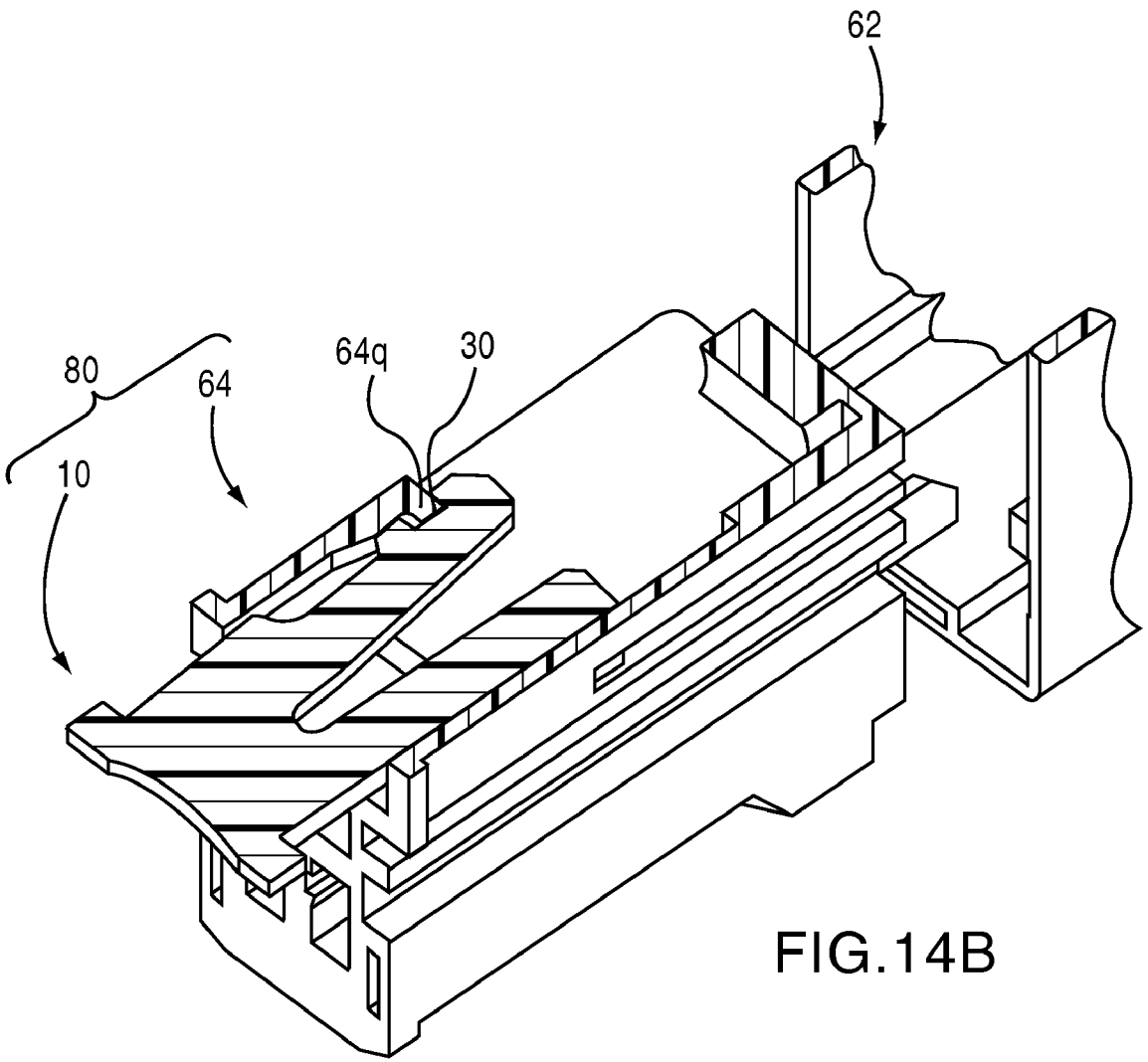

As shown in FIGS. 13A-13B, initially, the connector position assurance device 10 is inserted into the second connector cavity 64*b* by a first insertion force F1 with the first and second flexible arms being temporarily in the flexed state as the connector position assurance device 10 is advanced into the second connector inner cavity 64*b*. As shown in FIGS. 14A-14B, advancement of the connector position assurance device 10 takes place until the notch 30 and the second connector locking projection 64*q* engage each other in a locked condition. When in the locked condition, a cpa-second connector assemblage 80 is formed in a pre-set condition as shown in FIGS. 14A-14B with the first and second flexible arms in the normal relaxed state. Note that, in the locked condition, the notch 30 captures the second connector locking projection 64*q* in a manner that the connector position assurance device 10 cannot move inwardly into or outwardly from the second connector cavity 64*b* under normal operating conditions primarily because the square-shaped notch 30 captures a square-shaped second connector locking projection 64*q*.

Thereafter, the cpa-second connector assemblage 80 in the pre-set condition is aligned with the first connector opened end 62*a* as shown in FIG. 15 and is inserted partially into the first connector inner cavity 62*b* by a second insertion force F2 as shown in FIG. 16. This partial insertion occurs until the first connector stop projection 66 and the second connector stop projection 64*c* abut one another (FIG. 16) with the second connector stop projection 64*c* being disposed in front of the first connector stop projection 66. In FIG. 17, thereafter, the second connector latch 64*l* is moved downwardly by a downward force Fd to move the second connector latch 64*l* from the second connector latch normal relaxed state (FIGS. 15, 16 and 18A) to a second connector latch flexed state (FIG. 17). A third insertion force F3 is then applied to the cpa-second connector assemblage 80 further inserting the cpa-second connector assemblage 80 into the first connector inner cavity 62*b* so that the second connector stop projection 64*c* moves under the first connector stop projection 66. Also, in FIG. 18, the second connector stop projection 64*c* is positioned within the first connector inner cavity 62*b* behind the first connector stop projection 66 so that the downward force Fd can be relieved and the second connector latch 64*l* returns to the second connector latch normal relaxed state thereby releasably retaining the cpa-second connector assemblage 80 in the first connector inner cavity 62*b*.

Figure 18B:
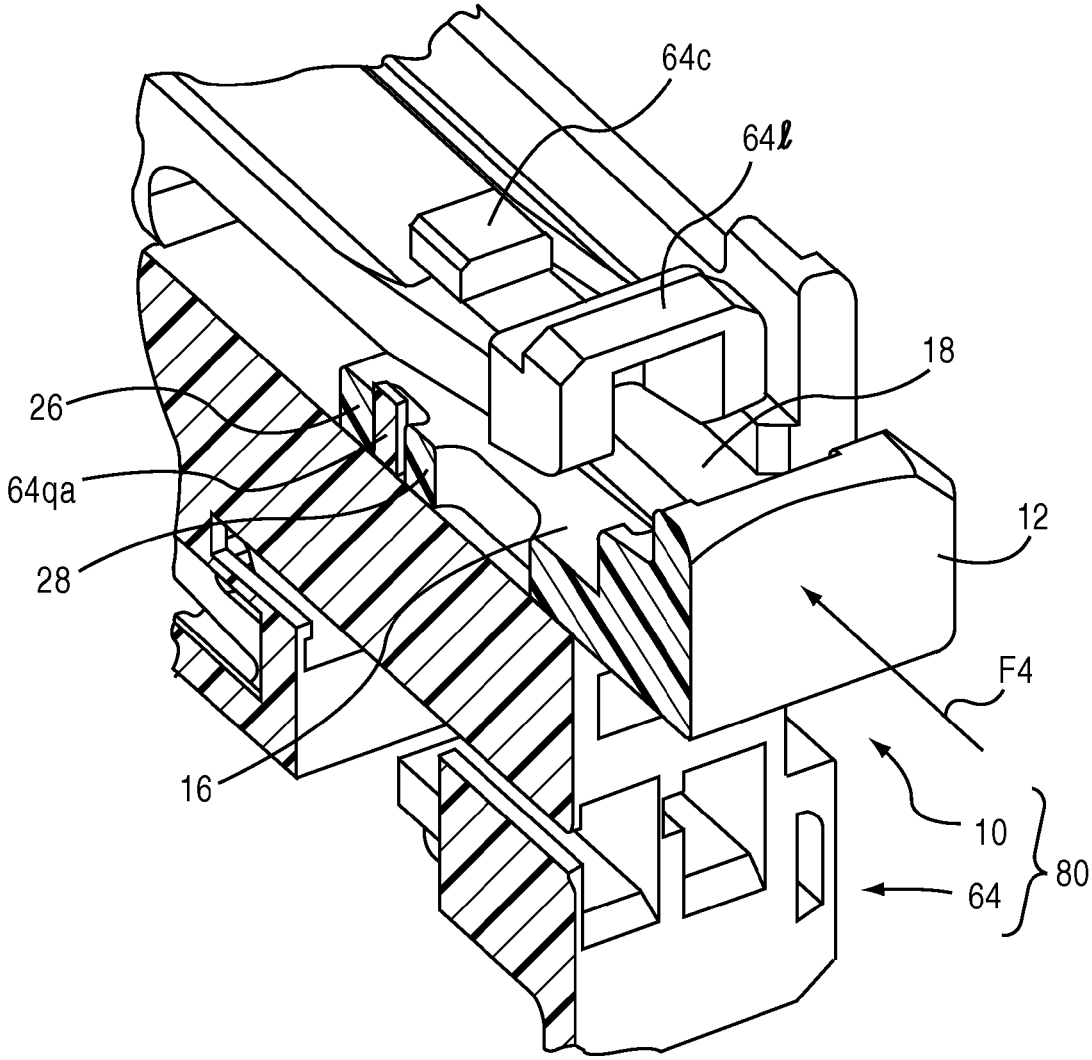
FIG. 18B is a partial side elevational perspective view in cross-section of the connector position assurance device and the second connector housing in the pre-set condition and being releasably retained in the first connector housing.
Figure 18C:
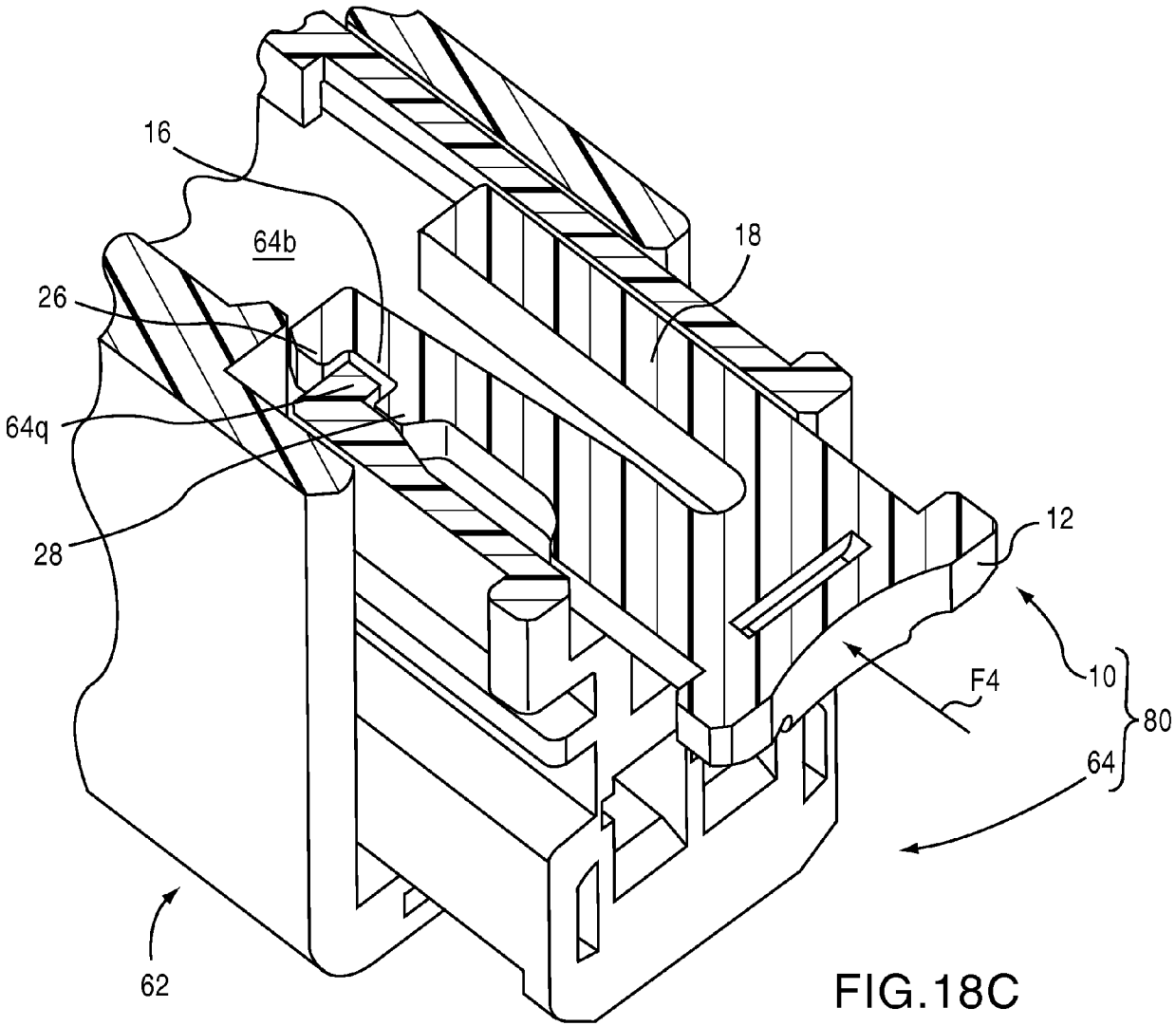
FIG. 18C is a partial top plan perspective view in cross-section of the connector position assurance device and the second connector housing in the pre-set condition and being releasably retained in the first connector housing.
Figure 19A:
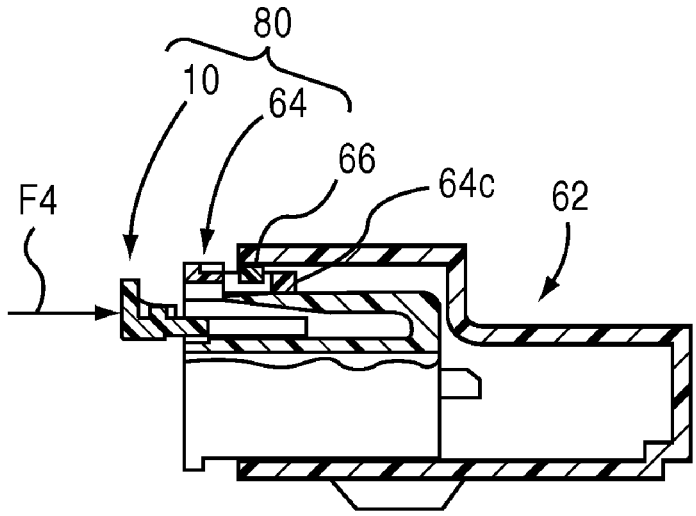
FIG. 19A is a side elevational view in cross-section of the connector position assurance device and the second connector housing released from the pre-set condition and being further inserted into the first connector housing.
Figure 20A:
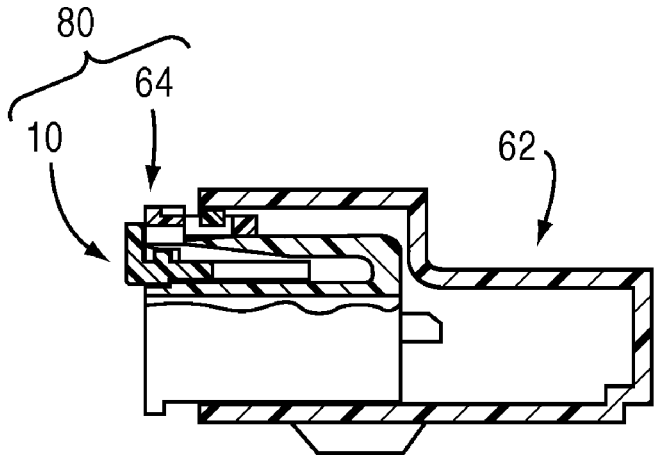
FIG. 20A is side elevational view in cross-section of the connector position assurance device, the second connector housing and the first connector housing in an engaged condition.
Figure 19B:
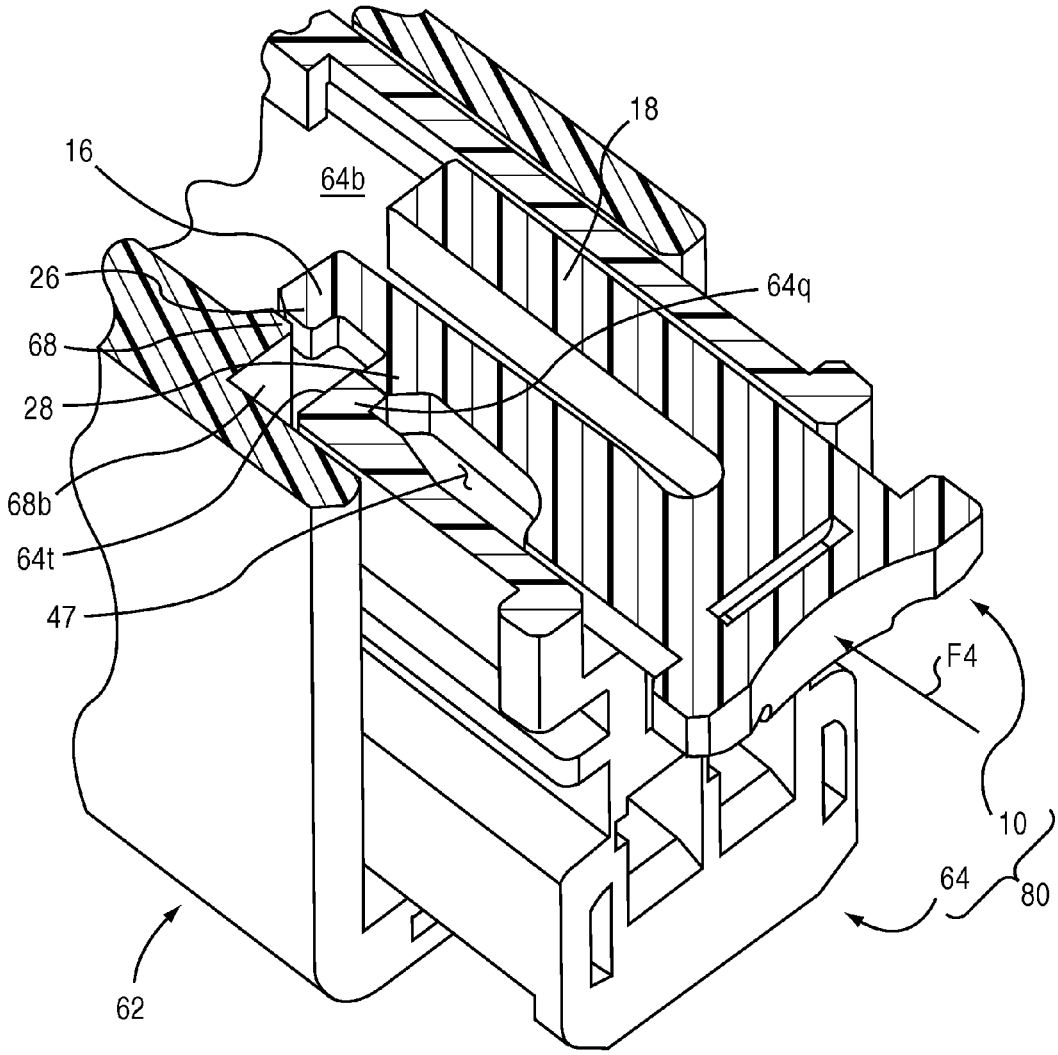
FIG. 19B is a partial top plan perspective view in cross-section of the connector position assurance device and the second connector housing released from the pre-set condition and being further inserted into the first connector housing.
Figure 20B:
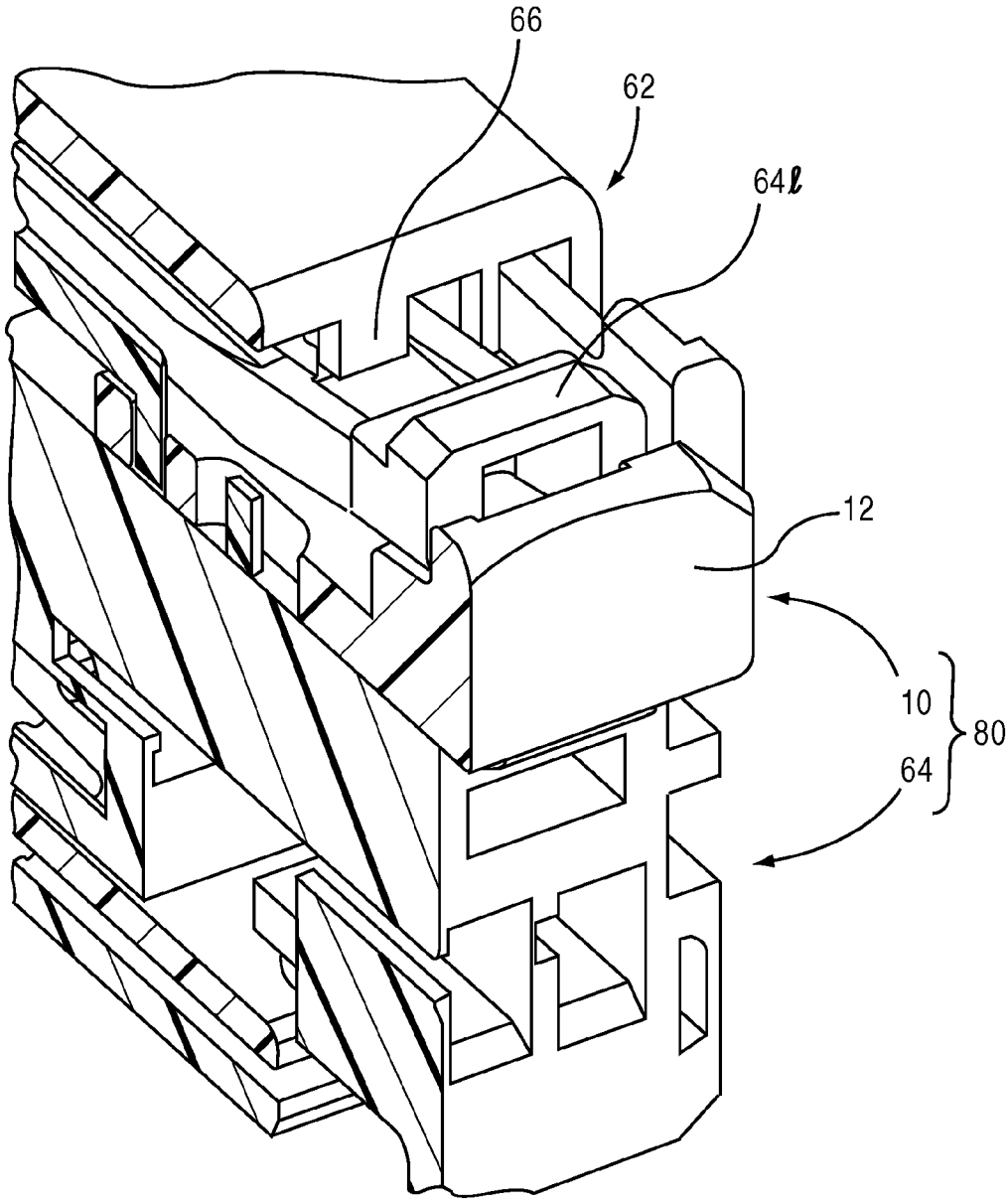
FIG. 20B is partial side elevational perspective view in cross-section of the connector position assurance device, the second connector housing and the first connector housing in an engaged condition.
Figure 20C:
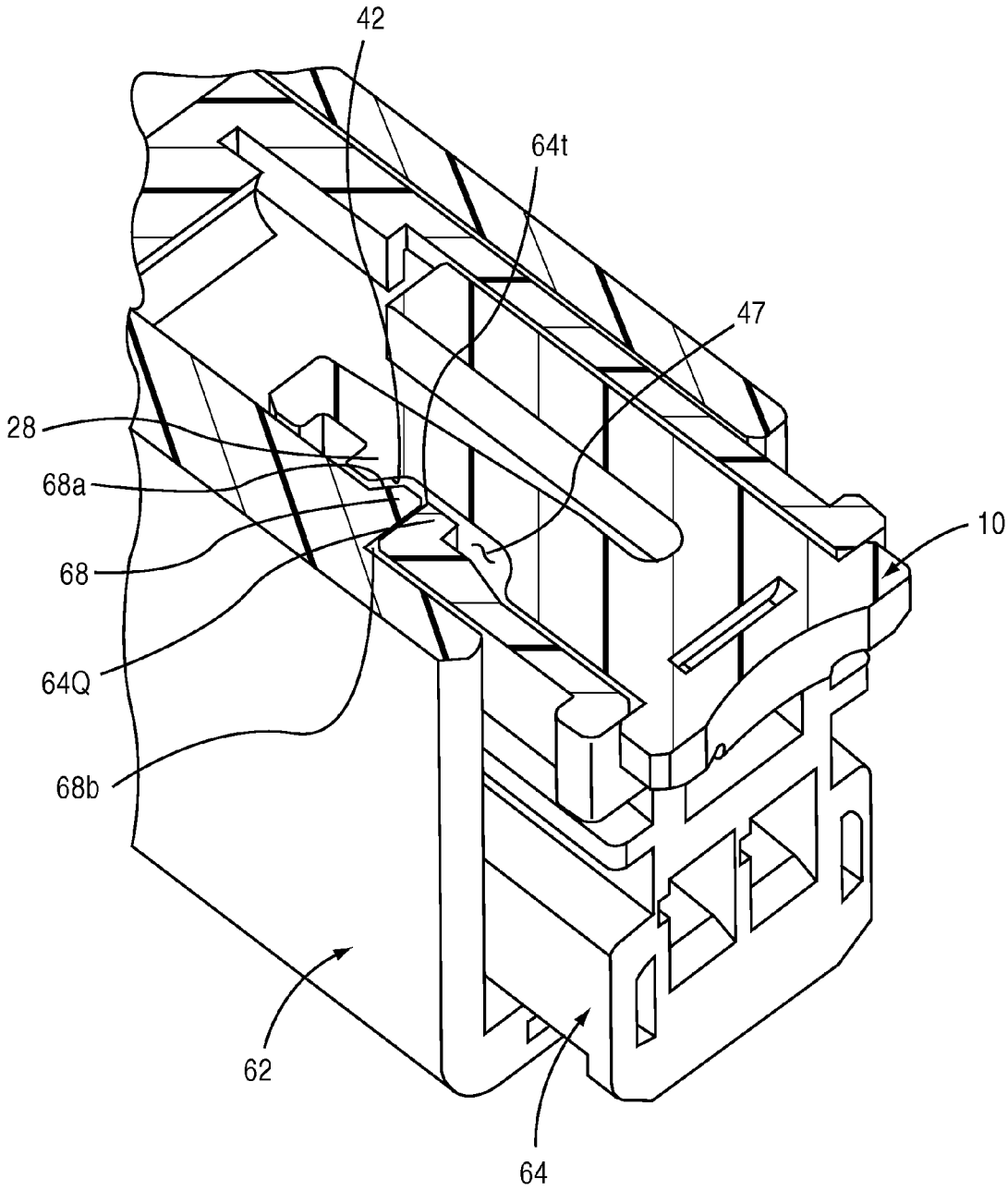
FIG. 20C is a partial top plan perspective view in cross-section of the connector position assurance device, the second connector housing and the first connector housing in an engaged condition.

Thereafter, in FIGS. 18A-18C, a fourth insertion force F4 is applied to the cpa-second connector assemblage 80 to complete insertion of the cpa-second connector 80 into the first connector inner cavity 64*b* and thus into an engaged condition (FIGS. 20A-20C). The fourth insertion force F4 moves the first flexible arm 16 from the normal relaxed state to the flexed state (FIG. 19B) and causing both the first finger projection 26 and the second finger projection 28 to slide over the first connector locking projection 68. As shown in FIGS. 20A-20B, once both the first finger projection 26 and the second finger projection 28 are slid over the first connector locking projection 68, the first flexible arm 16 returns to the normal relaxed state and both the first connector locking projection 68 and the second connector locking projection 64*q* are disposed within the indentation 47 in a juxtaposed manner. Thus, the first connector housing 62, the second connector housing 64 and the connector position assurance device 10 are rendered in an engaged condition. In short, the first connector locking projection 68 is disposed between the second finger projection 28 and the second locking projection 64*q* as shown in FIG. 20C when the first connector housing 62, the second connector housing 64 and the connector position assurance device 10 are in the engaged condition.

As best shown in FIG. 20C, the first connector locking projection 68 includes a first connector locking projection forwardly tapering sidewall surface 68*a* and a first connector locking projection flat surface 68*b* extending laterally and the second connector locking projection 64*q* includes a second connector locking projection flat surface 64*t* extending laterally. The second finger projection rearwardly tapering sidewall surface 42 and the first connector locking projection forwardly tapering sidewall surface 68*a* are facially opposed to each other and the first connector locking projection flat surface 68*b* and the second connector locking projection flat surface 64*t* are facially opposed to each other.

One of ordinary skill in the art will appreciate that the connector position assurance device 10 described above is not permanently stressed or flexed when the connector position assurance device and the second connector housing are in the pre-set condition or when the connector assembly apparatus is in its engaged condition. Further, because of its locked condition as described above, the connector position assurance 10 device avoids a "half mating" connection. Also, the connector position assurance device 10 is designed to be pre-set in the locked condition and thereby prevents unexpected connector disengagement. Further, the connector position assurance device 10 is suitable for low position connectors because of its compact design and simple shape.

The present invention, may, however, be embodied in various different forms and should not be construed as limited to the exemplary embodiments set forth herein; rather, these exemplary embodiments are provided so that this disclosure will be thorough and complete and will fully convey the scope of the present invention to those skilled in the art.

What is claimed is:

1. A connector position assurance device, comprising:

a base panel member extending along and about a longitudinal axis defining a longitudinal direction, a lateral axis defining a lateral direction and a transverse axis defining a transverse direction with the longitudinal axis, the lateral axis and the transverse axis being oriented perpendicularly relative to one another; and a latch assembly connected to and extending generally perpendicularly and forwardly from the base panel member in the longitudinal direction, the latch assembly having a first flexible arm and a second flexible arm disposed in a juxtaposed manner relative to one another on generally opposing sides of the longitudinal axis forming a channel therebetween, each one of the first and second flexible arms operative to move to and between a normal relaxed state and a flexed state generally in the lateral direction, each one the first and second flexible arms being resiliently biased to the normal relaxed state, the first flexible arm having a talon portion at a first flexible arm distal end thereof, the talon portion projecting laterally outwardly away from the channel, the second flexible arm having a guiding projection at a second flexible arm distal end thereof, the guide projection projecting laterally outwardly away from the channel.

2. A connector position assurance device according to claim 1, wherein when one of the first and second flexible arms moves from the normal relaxed state to the flexed state, the moving one of the first and second flexible arms moves toward a non-moving one of the first and second flexible arms.

3. A connector position assurance device according to claim 1, wherein when the first and second flexible arms move simultaneously from the normal relaxed state to the flexed state, the first and second flexible arms move toward each other.

4. A connector position assurance device to claim 1, wherein the talon portion includes a first finger projection and a second finger projection disposed apart from the first finger projection forming a notch therebetween.

5. A connector position assurance device, comprising:

a base panel member extending along and about a longitudinal axis defining a longitudinal direction, a lateral axis defining a lateral direction and a transverse axis defining a transverse direction with the longitudinal axis, the lateral axis and the transverse axis being oriented perpendicularly relative to one another; and a latch assembly connected to and extending generally Perpendicularly and forwardly from the base panel member in the longitudinal direction, the latch assembly having a first flexible arm and a second flexible arm disposed in a juxtaposed manner relative to one another on generally opposing sides of the longitudinal axis forming a channel therebetween, each one of the first and second flexible arms operative to move to and between a normal relaxed state and a flexed state generally in the lateral direction, each one the first and second flexible arms being resiliently biased to the normal relaxed state, the first flexible arm having a talon portion at a first flexible arm distal end thereof, the second flexible arm having a guiding projection at a second flexible arm distal end thereof, wherein the talon portion projects in the lateral direction facing away from the longitudinal axis, wherein the talon portion includes a first finger projection and a second finger projection disposed apart from the first finger projection forming a notch therebetween and wherein the first finger projection includes a first finger projection flat sidewall surface extending substantially parallel with the longitudinal and transverse axes and defining a sidewall plane, a first finger projection forwardly tapering sidewall surface connected to the first finger projection flat sidewall surface and tapering forwardly and inwardly towards the longitudinal axis as viewed in plan view and a first finger projection rearward flat sidewall surface connected generally perpendicularly to the first finger projection flat sidewall surface and the second finger projection includes a second finger projection flat sidewall surface coexistent with the first finger projection flat sidewall surface in the sidewall plane, a second finger projection forward flat sidewall surface connected generally perpendicularly to the second finger projection flat sidewall surface and facing the first finger projection rearward flat sidewall surface to define a generally square configuration of the notch and a second finger projection rearwardly tapering sidewall surface connected to the second finger projection flat sidewall surface and tapering rearwardly and inwardly towards the longitudinal axis.

6. A connector position assurance device according to claim 4, wherein the latch assembly includes an arm mounting panel connected to the base panel member at one arm mounting panel end with respective ones of the first and second flexible arms connected thereto at an opposing arm mounting panel end.

7. A connector position assurance device according to claim 6, wherein the first flexible arm is attached to the arm mounting panel laterally inwardly relative to a forward corner portion of the arm mounting panel to define an indentation between the forward corner portion and the second finger projection that extends along the first flexible arm.

8. A connector position assurance device according to claim 1, wherein the guiding projection projects in the lateral direction facing away from the longitudinal axis.

9. A connector position assurance device according to claim 8, wherein the guiding projection includes a guiding projection flat sidewall surface extending substantially parallel with the longitudinal and transverse axes, a guiding projection forwardly tapering sidewall surface connected to the guiding projection flat sidewall surface and tapering forwardly and inwardly towards the longitudinal axis as viewed in plan view and a guiding projection rearwardly tapering sidewall surface connected to the guiding projection flat sidewall surface and tapering rearwardly and inwardly towards the longitudinal axis as viewed in plan view.

10. A connector assembly apparatus, comprising:

a first connector housing having a first connector cavity formed thereinto and a first connector locking projection extending into the first connector housing;

a second connector housing a having a second connector cavity formed thereinto and a second connector locking projection extending into the second connector cavity; and a connector position assurance device having a base panel member and a latch assembly, the base panel member extending along and about a longitudinal axis defining a longitudinal direction, a lateral axis defining a lateral direction and a transverse axis defining a transverse direction with the longitudinal axis, the lateral axis and the transverse axis being oriented perpendicularly relative to one another, the latch assembly connected to and extending generally perpendicularly and forwardly from the base panel in the longitudinal direction, the latch assembly having a first flexible arm and a second flexible arm disposed in a juxtaposed manner relative to one another on generally opposing sides of the longitudinal axis to form a channel therebetween, each one of the first and second flexible arms operative to move to and between a normal relaxed state and a flexed state generally in the lateral direction, each one the first and second flexible arms being resiliently biased to the normal relaxed state, the first flexible arm having a talon portion at a first flexible arm distal end thereof, the talon portion projecting laterally outwardly away from the channel, the second flexible arm having a guiding projection at a second flexible arm distal end thereof, the guide projection projecting laterally outwardly away from the channel, the talon portion including a first finger projection and a second finger projection disposed apart from the first finger projection to form a notch therebetween, wherein initially the connector position assurance device is inserted into the second connector cavity by a first insertion force with the first and second flexible arms being temporarily in the flexed state until the notch and the second connector locking projection engage each other in a locked condition thereby forming a cpa-second connector assemblage in a pre-set condition with the first and second arm members in the normal relaxed state, thereafter the cpa-second connector assemblage in the pre-set condition is inserted into the first connector cavity by a second insertion force that causes the first arm member to move into the flexed state while the second arm member remains in the normal relaxed state and releases the notch and the second locking projection from the locked condition such that the second connector housing and the connector position assurance device slidingly penetrate into the first connector cavity with the first flexible arm in the flexed state until the second finger projection slides over the first connector locking projection so that the first flexible member returns to the normal relaxed state along with the second flexible member to render the first connector housing, the second connector housing and the connector position assurance device in an engaged condition.

11. A connector assembly apparatus according to claim 10, wherein the first connector locking projection is disposed between the second finger projection and the second locking projection as viewed in plan view when the first connector housing, the second connector housing and the connector position assurance device are in the engaged condition.

12. A connector assembly apparatus according to claim 11, wherein the second finger projection includes a second finger projection rearwardly tapering sidewall surface, the first connector locking projection includes a first connector locking projection forwardly tapering sidewall surface and a first connector locking projection flat surface extending laterally and the second connector locking projection includes a second connector locking projection flat surface extending laterally.

13. A connector assembly apparatus according to claim 12, wherein the second finger projection rearwardly tapering sidewall surface and the first connector locking projection forwardly tapering sidewall surface are facially opposed to each other and the first connector locking projection flat surface and the second connector locking projection flat surface are facially opposed to each other.

14. A connector assembly apparatus, comprising:

a first connector housing extending along and about a longitudinal axis and having a first connector opened end, a first connector inner cavity, a first connector stop projection and a first connector locking projection, the first connector stop projection extending from a first connector upper wall into the first connector inner cavity, the first connector stop projection disposed adjacent the first connector opened end, the first connector locking projection extending from a first connector sidewall oriented perpendicularly to the first connector upper wall and extending into the first connector inner cavity;

a second connector housing extending along and about the longitudinal axis and sized and adapted to be received by the first connector inner cavity through the first connector opened end, the second connector housing including a second connector housing body, a second connector latch, a stop projection, a ramped second connector sidewall and a slotted second connector side wall facially opposing the ramped second connector sidewall, the second connector housing body member extending between a second connector front end and a second connector rear end, the second connector latch pivotally connected adjacent the second connector rear end and extending between the second connector front and rear ends such that the second connector latch, the second connector housing body member, the ramped second connector sidewall and the slotted second connector sidewall define a second connector inner cavity with a second connector opened end at the second connector front end, the second connector latch operative to move to and between a second connector latch normal relaxed state and a second connector flexed state with the second connector latch being resiliently biased to the second connector latch normal relaxed state, the stop projection connected to the second connector latch between the second connector front and rear ends and extending upwardly therefrom and away from the second connector inner cavity, the ramped second connector sidewall including a first flat cam surface, a ramped cam surface, a second flat cam surface and a second connector locking projection progressively extending into the second connector inner cavity from the second connector front end with the ramped cam surface interconnecting the first and second flat cam surfaces and the second flat cam surface disposed between the ramped cam surface and the second connector locking projection, the slotted second connector sidewall including a flat contact surface facially opposing at least the first flat cam surface and extending parallel to the first cam surface and a slot extending longitudinally and facially opposing at least the second connector locking projection; and a connector position assurance device including a base panel member and a latch assembly, the base panel member extending along and about a longitudinal axis defining a longitudinal direction, a lateral axis defining a lateral direction and a transverse axis defining a transverse direction with the longitudinal axis, the lateral axis and the transverse axis being oriented perpendicularly relative to one another, the latch assembly connected to and extending generally perpendicularly and forwardly from the base panel member in the longitudinal direction, the latch assembly having a first flexible arm and a second flexible arm disposed in a juxtaposed manner relative to one another on generally opposing sides of the longitudinal axis forming a channel therebetween, each one of the first and second flexible arms operative to move to and between a normal relaxed state and a flexed state generally in the lateral direction, each one the first and second flexible arms being resiliently biased to the normal relaxed state, the first flexible arm having a talon portion at a first flexible arm distal end thereof, the talon portion projecting laterally outwardly away from the channel, the second flexible arm having a guiding projection at a second flexible arm distal end thereof, the guide projection projecting laterally outwardly away from the channel, either one of the first and second flexible arms operative to move from the normal relaxed state to the flexed state with the moving one of the first and second flexible arms moves toward a non-moving one of the first and second flexible arms, the talon portion projecting in the lateral direction facing away from the channel and including a first finger projection and a second finger projection disposed apart from the first finger projection forming a notch therebetween, the latch assembly including, an arm mounting panel connected to the base panel member at one arm mounting panel end with respective ones of the first and second flexible arms connected thereto at an opposing arm mounting panel end, the first flexible arm attached to the arm mounting panel laterally inwardly relative to a forward corner portion of the arm mounting panel to define an indentation between the forward corner portion and the second finger projection that extends along the first flexible arm, wherein initially the connector position assurance device is inserted into the second connector cavity by a first insertion force with the first and second flexible arms being temporarily in the flexed state as the connector position assurance device is advanced into the second connector inner cavity until the notch and the second connector locking projection engage each other in a locked condition thereby forming a cpa-second connector assemblage in a pre-set condition with the first and second flexible arms in the normal relaxed state, thereafter the cpa-second connector assemblage in the pre-set condition is aligned with the first connector opened end and inserted partially into the first connector inner cavity by a second insertion force until the first connector stop projection and the second connector stop projection abut one another, thereafter, the second connector latch is moved downwardly by a downward force to move the second connector latch from the second connector latch normal relaxed state to the second connector latch flexed state and a third insertion force applied to the cpa-second connector assemblage further inserts the cpa-second connector assemblage into the first connector inner cavity so that the second connector stop projection slides under the first connector stop projection and is positioned within the first connector inner cavity behind the first connector stop projection so that the downward force can be relieved and the second connector latch returns to the second connector latch normal relaxed state thereby releasably retaining the cpa-second connector assemblage in the first connector inner cavity, thereafter, a fourth insertion force is applied to move the first flexible arm from the normal relaxed state to the flexed state and to cause both the first finger projection and the second finger projection to slide over the first connector locking projection in order to return the first flexible arm to the normal relaxed state and with both the first connector locking projection and the second connector locking projection disposed within the indentation thereby rendering the first connector housing, the second connector housing and the connector position assurance device in an engaged condition.

* * * * *